US006343884B1

(12) United States Patent
Watanabe et al.

(10) Patent No.: US 6,343,884 B1
(45) Date of Patent: Feb. 5, 2002

(54) PAPER ROLL LOADING METHOD AND PRINTER USING THE METHOD

(75) Inventors: Sumio Watanabe, Hoofddorp (NL); Kunihiko Funada, Shinagawa (JP)

(73) Assignee: Fujitsu Takamisawa Component Ltd., Tokyo (JP)

( * ) Notice: Subject to any disclaimer, the term of this patent is extended or adjusted under 35 U.S.C. 154(b) by 0 days.

(21) Appl. No.: 09/692,209

(22) Filed: Oct. 20, 2000

(30) Foreign Application Priority Data

Dec. 22, 1999 (JP) ..... 11-365557

(51) Int. Cl.[7] ..... B41J 11/70; B41J 13/00
(52) U.S. Cl. ..... 400/621; 400/578
(58) Field of Search ..... 400/621, 578

(56) References Cited

U.S. PATENT DOCUMENTS 4,639,739 A * 1/1987 Tsutsumi ..... 346/76
4,663,638 A * 5/1987 Hirose ..... 346/136
5,727,889 A * 3/1998 Koyabu ..... 400/621
5,993,093 A * 11/1999 Schoennauer et al. ..... 400/621
6,118,469 A * 9/2000 Hosomi ..... 347/222
6,155,731 A * 12/2000 Bertalan et al. ..... 400/621

* cited by examiner

*Primary Examiner*—John S. Hilten
*Assistant Examiner*—Charles H. Nolan, Jr.
(74) *Attorney, Agent, or Firm*—Staas & Halsey LLP

(57) ABSTRACT

A printer includes a paper roll holder holding a roll of paper, a paper feed path guiding the paper from the paper roll holder, a printing head provided on a portion of the paper feed path for printing on the paper, and a cutter disposed on the paper feed path between the paper roll holder and the printing head for cutting the unraveled paper roll. A method for loading a paper roll to a printer includes the step of cutting the unraveled paper roll at a position upstream of the printing head, before the edge of the paper driven reaches a position downstream of the printing head. By positioning the cutter upstream of the printing head and cutting the paper before the forward edge of the paper moves downstream of the printing head, the printing head and a platen roller can be kept free of any dirt adhering to the paper.

6 Claims, 20 Drawing Sheets

PAPER ROLL LOADING METHOD AND PRINTER USING THE METHOD

BACKGROUND OF THE INVENTION

1. Field of the Invention

The present invention relates to a paper roll loading method for loading a roll of paper at a printer and a printer in which rolls of paper are used.

2. Description of the Related Art

One type of printer is that which uses rolls of paper, such type of printer having a paper roll holder holding the paper roll. In this type of printer, an operator places a roll of paper into the paper roll holder and sets the roll so that a printer can print to the paper.

In the present specification, the term "loading a/the paper roll" refers to an operation of loading a roll of paper at a position at which a printer can then print to the paper roll, including inserting the roll of paper into the paper roll holder and a state in which a forward edge of an outermost portion of paper unraveled from the paper roll has passed through a printing mechanism including a printing head for printing to the paper.

The above-described loading of the roll of paper poses, for example, the following basic requirements:

1) Ease of handling. For example, an operator should be able to set the roll of paper even when the operator is wearing gloves, because depending on the conditions under which the printer is operated it may be essential that the operator wear gloves.

2) A dirty portion of the paper unraveled from the roll should not be fed to the printing mechanism.

3) The printing mechanism is not dirtied or damaged.

An example of a conventional printer 20 that uses a roll of paper 10 as described above is shown in FIG. 1. As shown in the diagram, the printer 20 is constructed so that a printing head 22 is positioned in front of the paper roll holder 25. The printer 20 itself comprises a main body 21, the above-mentioned printing head 22 fixedly mounted on the main body 21, and a platen roller 23 provided on a front edge of an upwardly openable cover 24 and a paper roll holder 25.

In order to set the paper roll 10 to the printer 20, an operator performs the following operations:

(1) An outermost portion of paper is unraveled from the roll as shown by reference numeral 11.

(2) The cover 24 is opened.

(3) The paper roll 10 is placed in the paper roll holder 25 and the paper 11 unraveled therefrom is extended outside the printer 20.

(4) The cover 24 is closed.

(5) The unraveled portion of paper 11 is cut at a point somewhere past the printing head 22, that is, on a downstream side of the printing head 22, opposite a side of the printing head 22 nearest the paper roll holder 25.

FIG. 2 is a diagram showing another conventional printer 30 using the roll of paper 10 described above. In the printer 30 shown in the diagram, the printing head 32 is positioned inside the paper roll holder 35 and the printer 30 itself comprises a main body 31, a printing head 32, a platen roller 33 fixedly mounted on the main unit 31, a cover 34 openable toward the bottom, and a paper roll holder 35.

In order to set the paper roll 10 to the printer 30, an operator performs the following operations:

(1) An outermost portion of paper is unraveled from the roll as shown by reference numeral 11.

(2) The cover 34 is opened.

(3) The paper 11 unraveled from the paper roll 10 is held at both sides and fed between the printing head 32 and the platen roller 33, the platen roller 33 is briefly rotated and a forward edge of the paper 11 is passed between the printer head 32 and the platen roller 33.

(4) The paper roll 10 is placed inside the paper roll holder 35, the roll of paper 10 is supported with one hand while the cover 34 is closed with the other hand.

(5) The unraveled paper 11 is cut at a point somewhere past the printing head 22, that is, on a downstream side of the printing head 22.

However, both types of printers described above have disadvantages.

In the printer 20 shown in FIG. 1, although the operation of loading the paper roll 10 can be performed with the operator wearing gloves, because the printing head 22 and the platen roller 23 are positioned in front of the paper roll holder 25, they can be easily accidentally contacted and dirtied by the operator's hand during that loading operation. If the printing head 22 and the platen roller 23 are dirtied the quality of the resulting print diminishes and even the printed paper is dirtied as well. For this reason the printer 20 shown in FIG. 1 is unsuitable for locations in which the operator is likely to be wearing gloves.

In the printer 30 shown in FIG. 2, the printing head 32 and the platen roller 33 are placed inside the paper roll holder 35, thus they are not likely to be easily accidentally contacted by the operator's hand and hence are unlikely to be directly dirtied thereby. However, the operator wearing gloves must still grasp the paper unrolled from the roll at both sides and feed the paper between the printing head 32 and the platen roller 33, at which time any dirt adhering to the paper 11 dirties the printing head 32 and the platen roller 33 when the paper 11 passes therebetween.

Additionally, with the operator wearing gloves it is virtually impossible to perform the relatively delicate task of threading the paper 11 between the printing head 32 and the platen roller 33. For this reason the printer 20 shown in FIG. 2 also is unsuitable for locations in which the operator is likely to be wearing gloves.

SUMMARY OF THE INVENTION

Accordingly, it is the object of the present invention to provide an improved and useful, method for loading a paper roll to a printer and a printer using the method, in which the disadvantages described above are eliminated.

The above-described object of the present invention is achieved by a printer, comprising:

- a paper roll holder for holding a roll of paper;
- a paper feed path guiding the paper from the paper roll;
- a printing head provided on a portion of the paper feed path for printing on the paper; and
- a cutter disposed on the paper feed path between the paper roll holder and the printing head, for cutting the unraveled paper roll.

According to the invention described above, the cut edge of the paper cut by the cutter retains its stiffness and thus the paper can be fed accurately and easily to and through the printing head. Thereby, it is no longer necessary to provide the print head on an easily accessible part of the printer, thus providing improved print quality. In the printer of the present invention, the chance that the print head is dirtied or damaged is reduced substantially.

The above-described object of the present invention is also achieved by the printer as described above, further comprising a paper cut detector that detects a cutting of the portion of paper by the cutter and starts a paper feeder.

According to the invention described above, the starting of the paper feeder is automatic, eliminating the need for a separate operation to start the feeder.

Additionally, the above-described object of the present invention is also achieved by printer as described above, wherein the paper feed path includes a feed roller (62) and a platen roller (53).

The above-described object of the present invention is also achieved by the printer as described above, wherein the cutter is provided on a front edge of a cover of the paper roll holder.

According to the invention described above, the structure of the cutter can be simplified.

Additionally, the above-described object of the present invention is also achieved by the printer as described above, wherein a blade of the cutter is slanted with respect to a direction in a width of the paper roll.

According to the invention described above, the paper is cut gradually instead of all at once. Due to the concentration of force at the point of the blade making contact with the paper, the amount of the force needed to accomplish the diagonal cut is less than would be required if the cut were to be accomplished straight across the width of the paper, and as a result the cut is clean and smooth.

Additionally, the above-described object of the present invention is achieved by a method for loading a paper roll to a printer, the printer comprising:

a paper roll holder for holding a roll of paper;

a paper feed path guiding the paper from the paper roll holder;

a printing head provided on a portion of the paper feed path for printing on the paper; and a cutter disposed on the paper feed path between the paper roll holder and the printing head, for cutting the unraveled paper roll, the method comprising the steps of:

setting the paper roll on the paper roll holder;

unraveling the paper roll to a position beyond a position of the cutter;

cutting the unraveled paper roll; and driving an edge of the cut paper to a position such that the edge of the paper reaches a position downstream of the printing head.

Additionally, the above-described object of the present invention is also achieved by a method for loading a paper roll to a printer, the printer comprising:

a paper roll holder for holding a roll of paper;

a paper feed path guiding the paper from the paper roll holder;

a printing head provided on a portion of the paper feed path for printing on the paper; and a cutter disposed on the paper feed path between the paper roll holder and the printing head, for cutting the unraveled paper roll, comprising the step of cutting the unraveled paper roll at a position upstream of the printing head, before the edge of the paper driven reaches a position downstream of the printing head.

According to the invention described above, the cut edge of the paper retains its stiffness and thus can be fed accurately to and through the printing head, providing improved print quality.

Other objects, features and advantages of the present invention will become more apparent from the following detailed description when read in conjunction with the accompanying drawings.

DESCRIPTION OF THE PREFERRED EMBODIMENTS

A description will now be given of embodiments of the present invention, with reference to the accompanying drawings. It should be noted that identical or corresponding elements in the embodiments are given identical or corresponding reference numbers in all drawings and detailed descriptions thereof are omitted.

FIGS. 3, 4, 5, 6, 7, 8, 9A, 9B, 9C, 10, 11A, 11B, 11C, 12, 13A, 13B, 13C, 14 and 15 are diagrams showing a printer 40 according to a first embodiment of the present invention.

Figure 1:
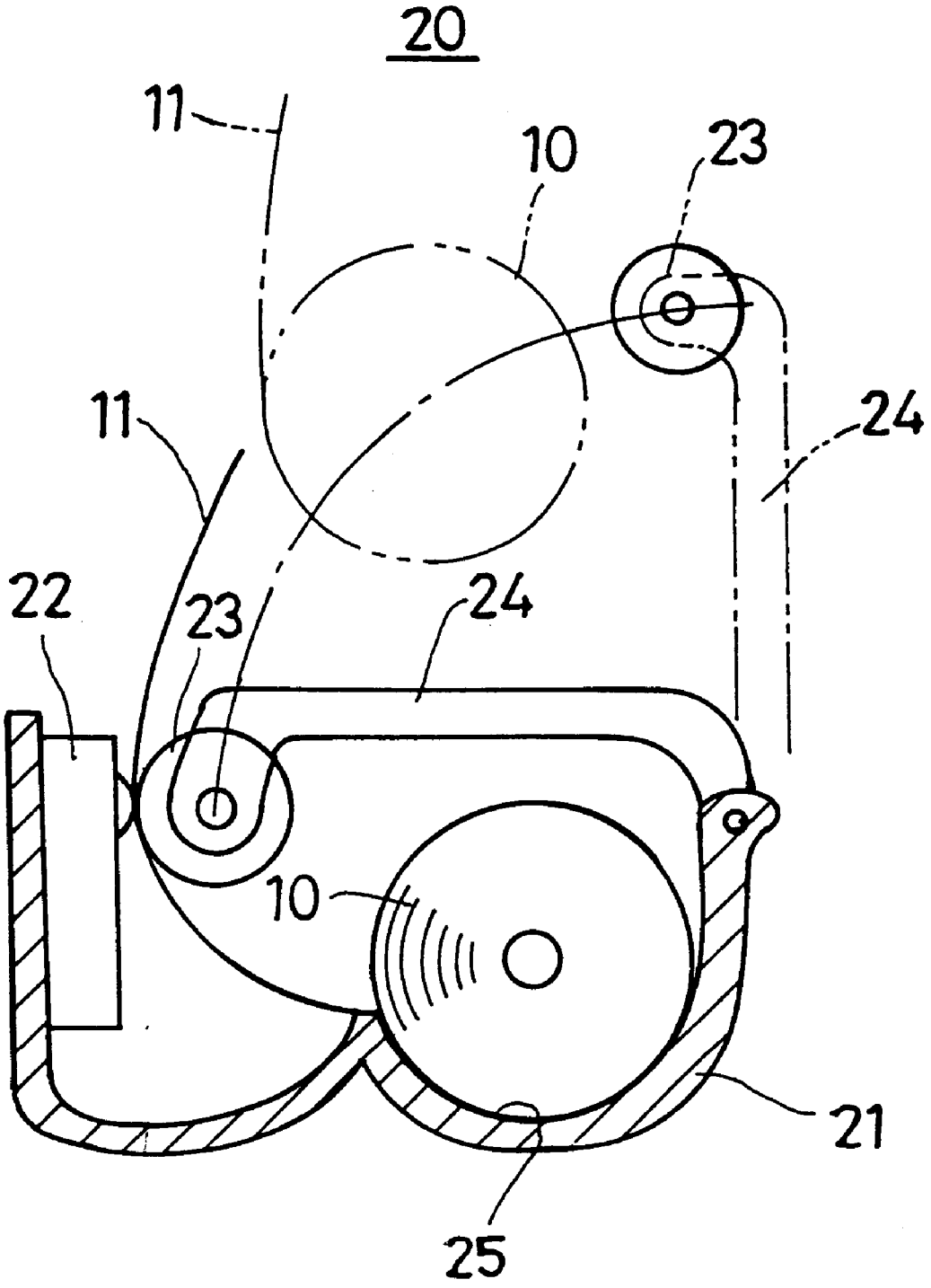
FIG. 1 is a diagram showing an example of a conventional printer.
Figure 2:
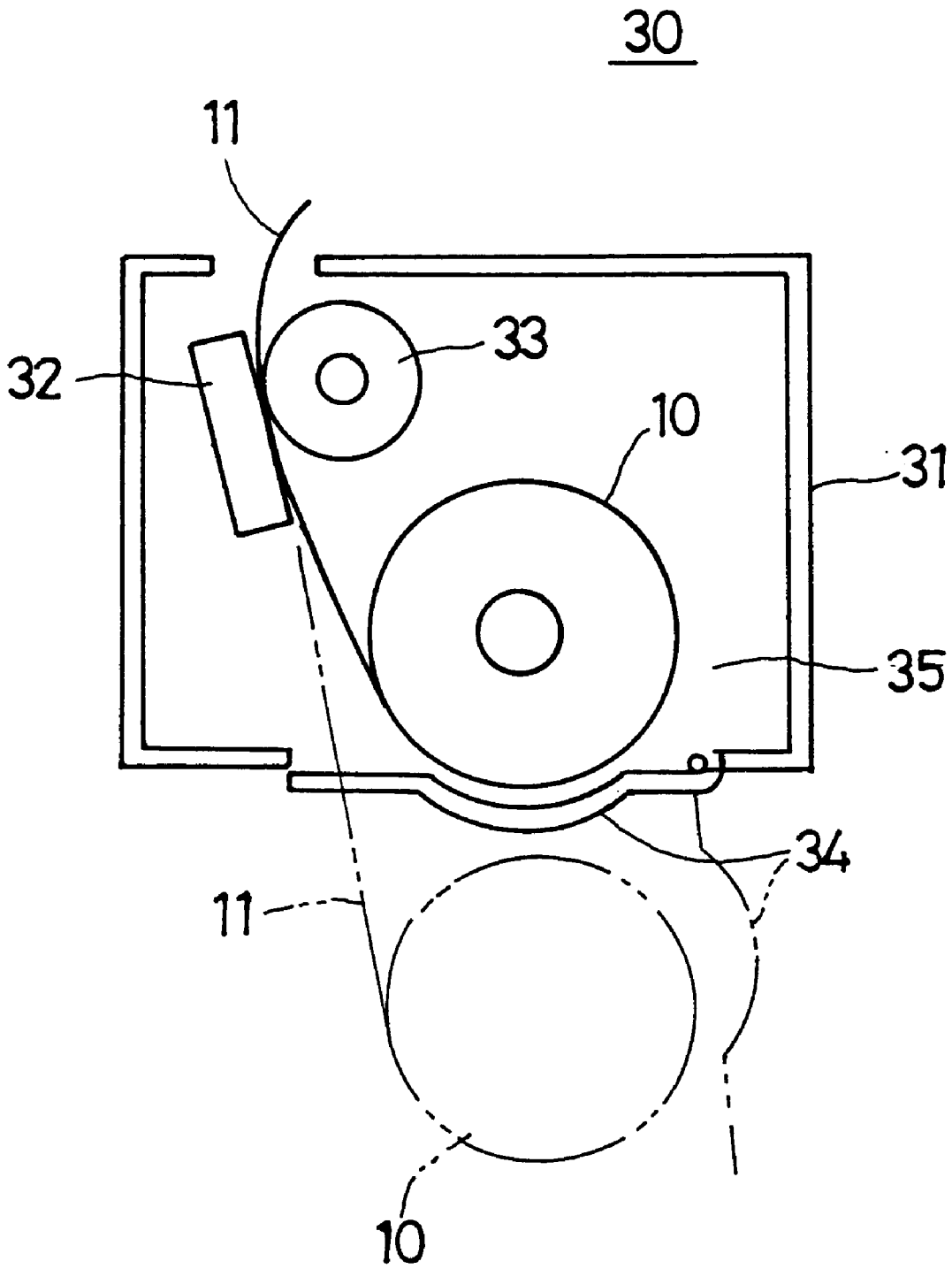
FIG. 2 is a diagram showing another example of a conventional printer.
Figure 3:
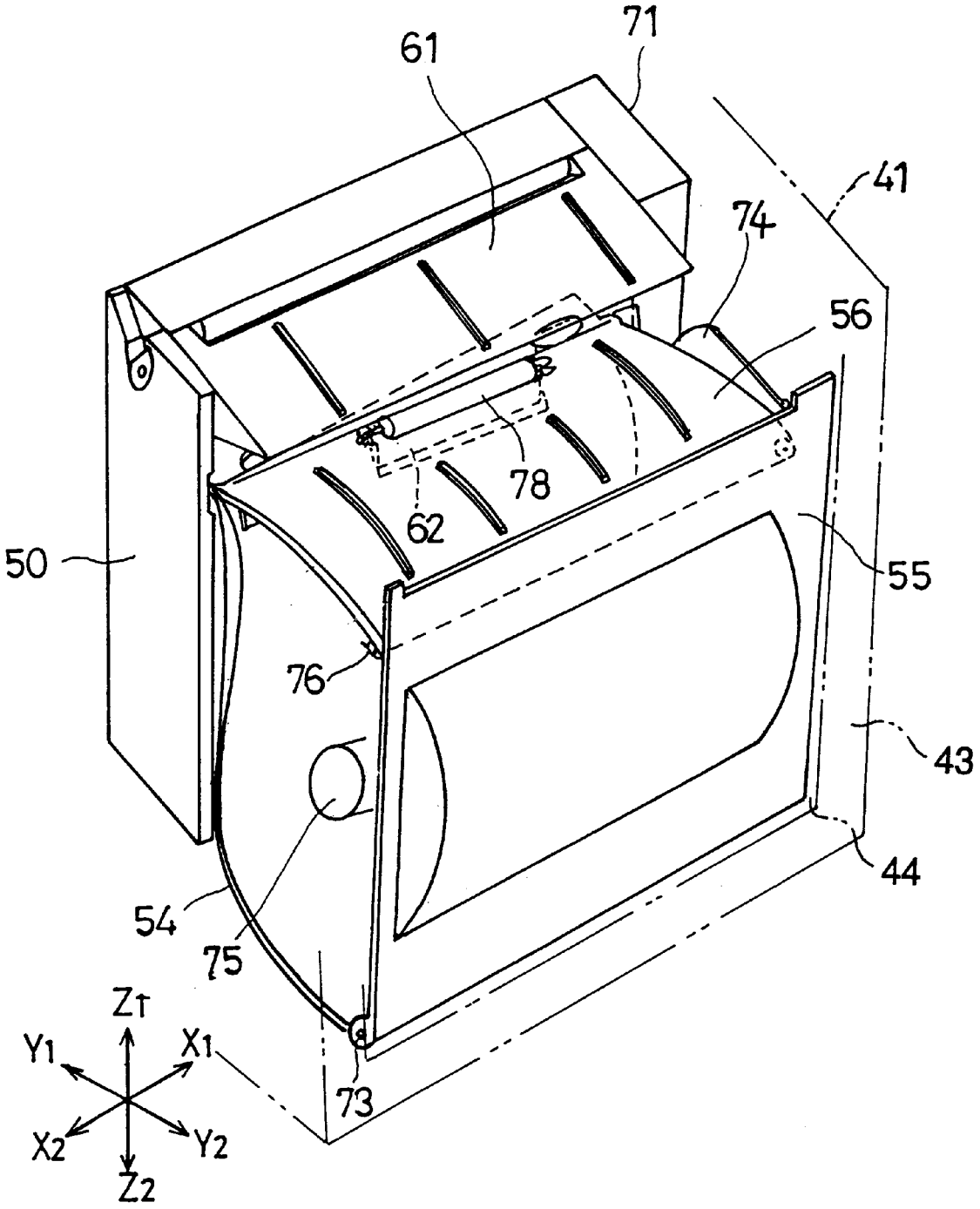
FIG. 3 is a diagram showing a perspective view of a printer according to a first embodiment of the present invention.
Figure 4:
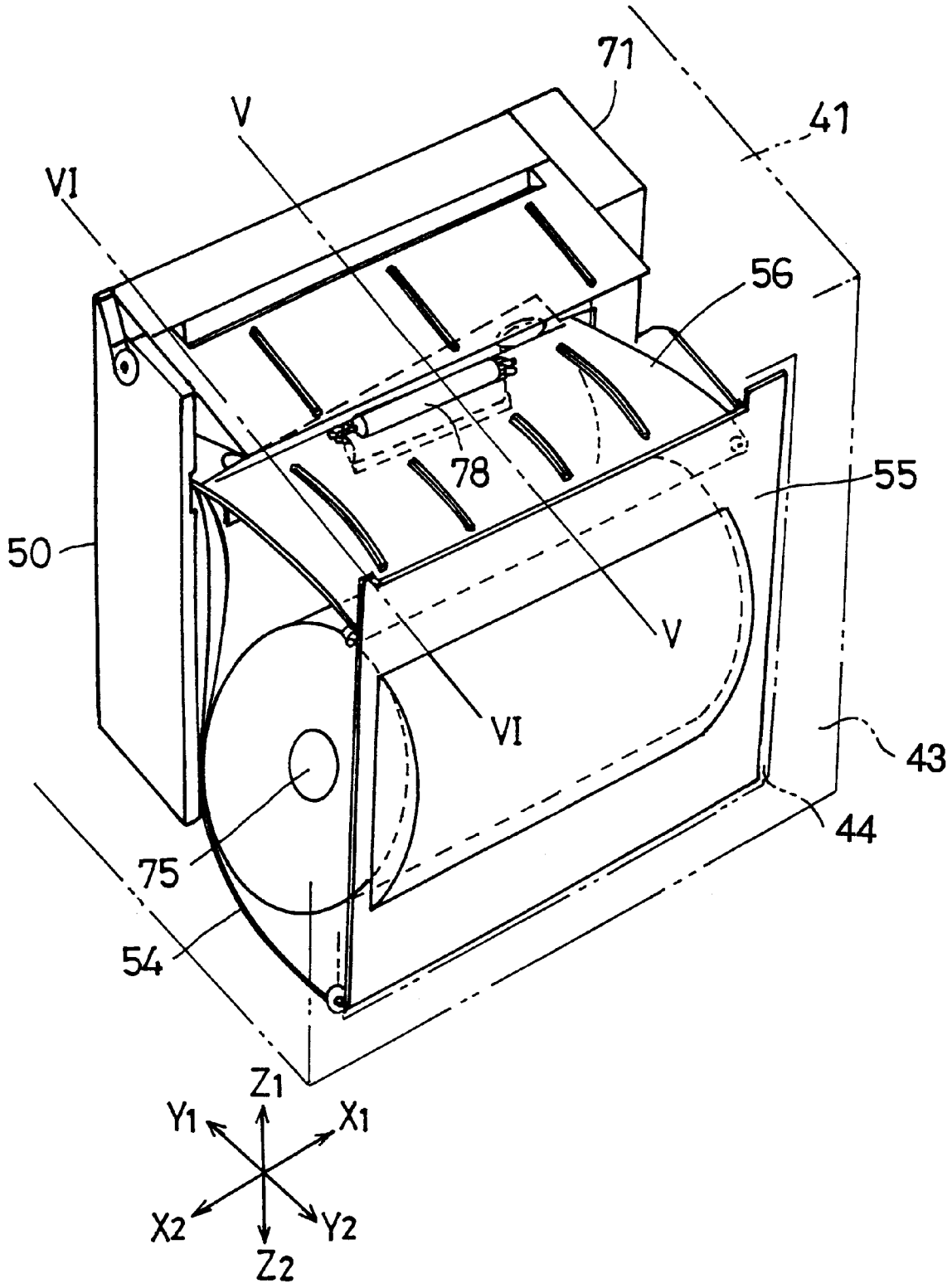
FIG. 4 is a diagram showing a perspective view of the printer of FIG. 3 for a state after a roll of paper has been set.
Figure 5:
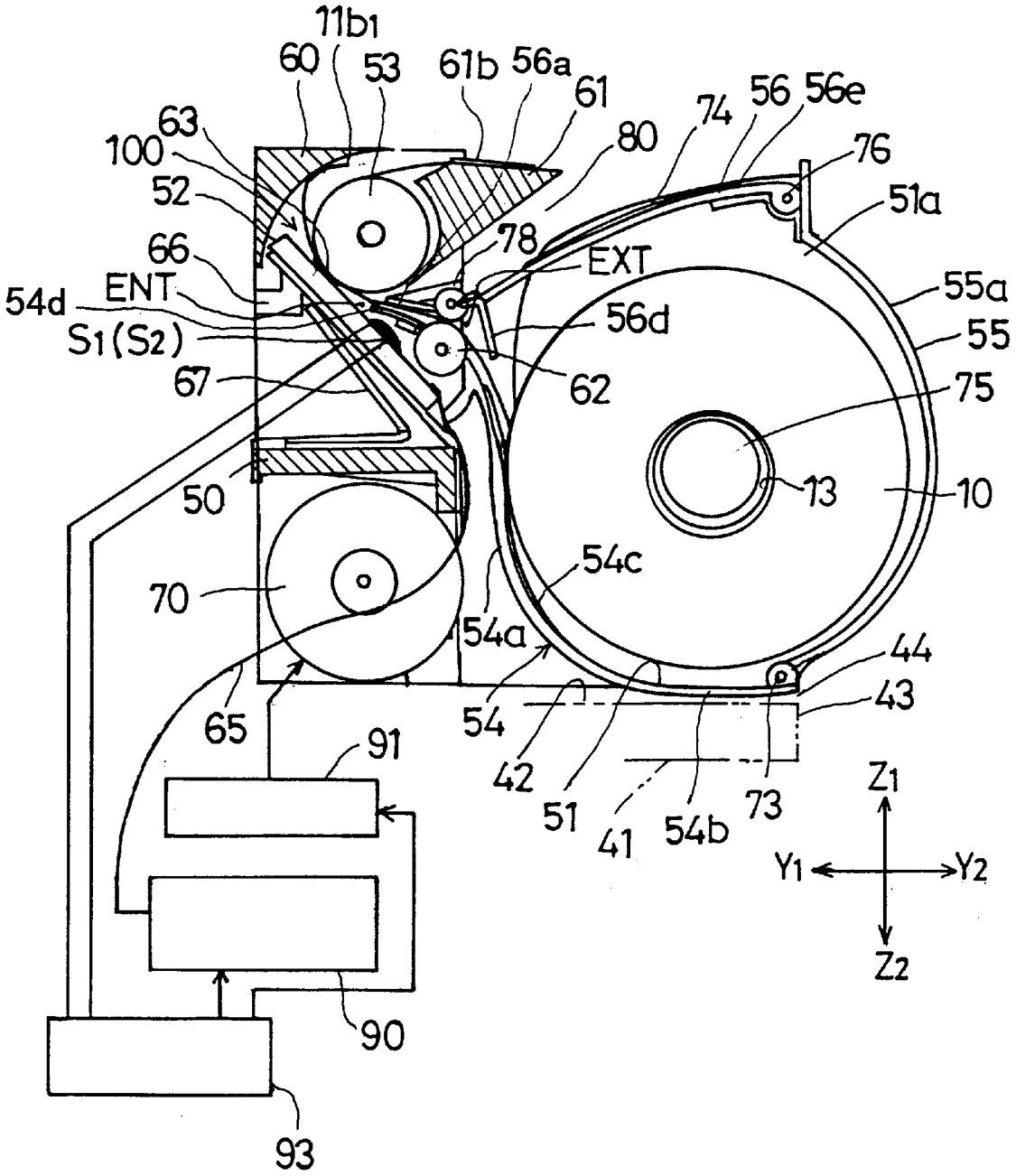
FIG. 5 is a diagram showing a cross-sectional view of the'printer of FIG. 3 along the line V—V shown in FIG. 4.

FIG. 3 is a diagram showing a perspective view of a printer 40 according to a first embodiment of the present invention. As can be seen from the drawing, the printer 40 is of a type that uses a thermosensitive paper roll 10 (hereinafter referred to as a paper roll or a roll of paper), and is, for example, inserted in a device 41, which may be a device mounted in a vehicle for recording an operation of the vehicle (hereinafter referred to simply as the device 41) as shown in FIGS. 3, 4 and 5. For ease of explanation, it should be noted that X1–X2 represents a lateral, that is, a latitudinal direction, Y1–Y2 represents a longitudinal direction, and Z1–Z2 represents a vertical direction. It is in the latitudinal X1–X2 direction that the paper roll 10 is unrolled. An operator's hand approaches the printer 40 and the device 41. A space 42 for accommodating the printer 40 is formed on a front surface 43 of the device 41, and it is in this space that the printer 40 is inserted. A substantially rectangular opening 44 is provided on the front 43 of the device 41, as shown in FIG. 3.

Figure 7:
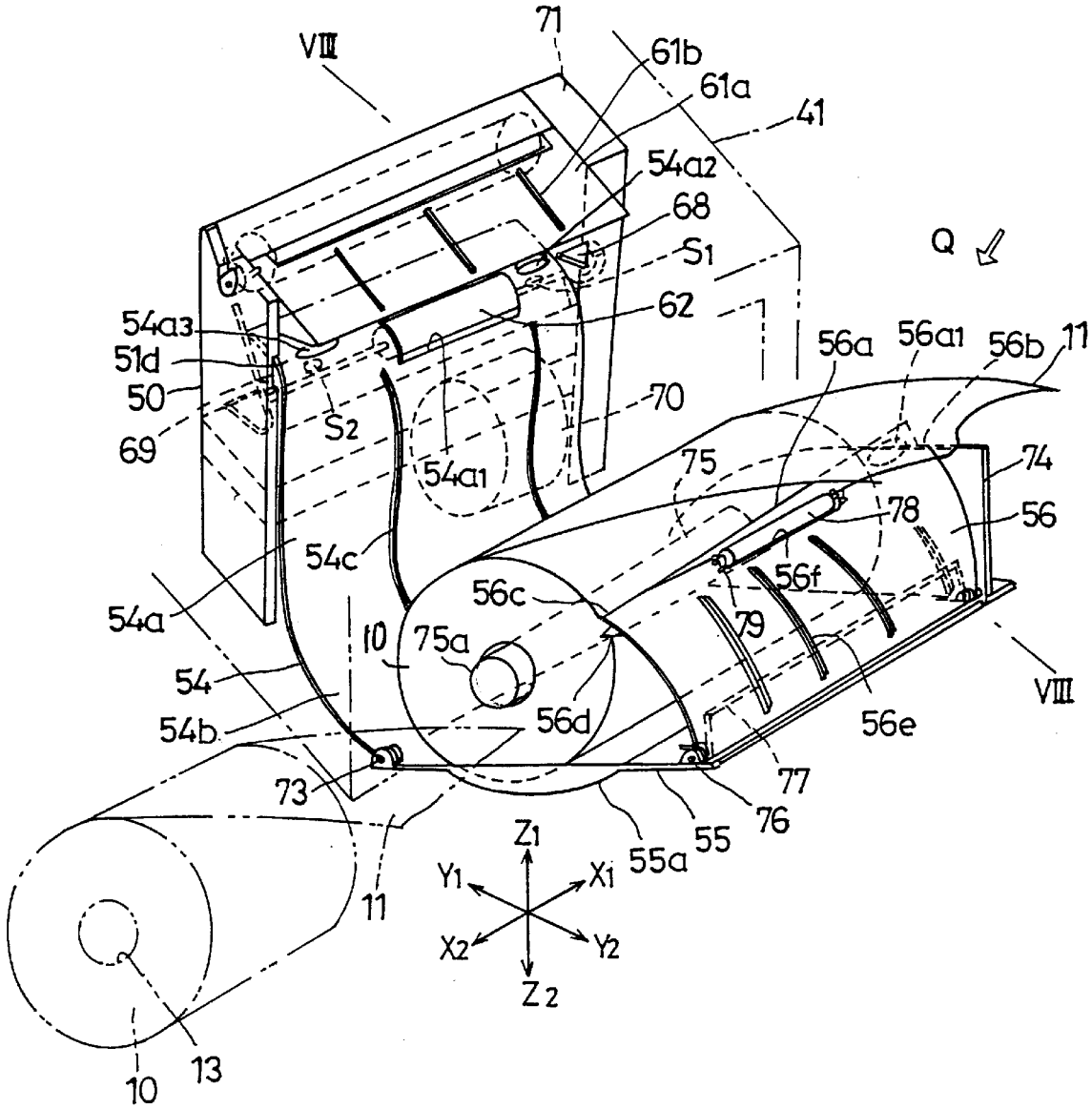
FIG. 7 is a diagram showing of the printer of FIG. 3 for a state in which the cover of the printer is open.
Figure 8:
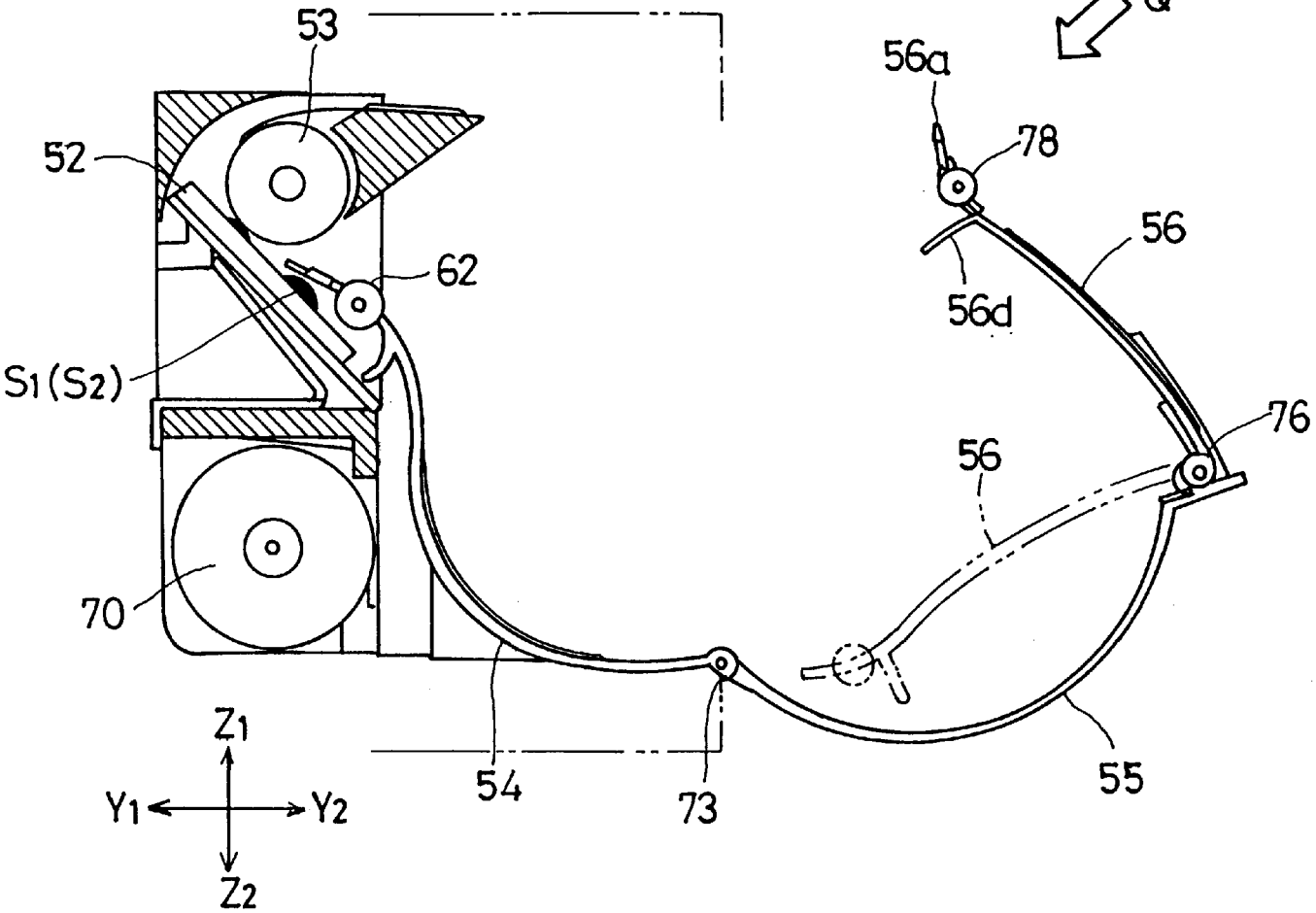
FIG. 8 is a diagram showing a cross-sectional view of the printer of FIG. 3 along the line VIII—VIII shown in FIG. 7.

In general, the loading of the paper roll 10 into the printer 40 involves opening the paper roll holder 51 and inserting the paper roll 10 as shown in FIGS. 7 and 8, and further, cutting a portion of the paper with the cut edge and feeding the paper onward with the edge thus formed as the leading or forward edge as shown in FIGS. 12 and 13A, 13B and 13C, and so obtaining a state like that shown in FIGS. 4 and 5.

Referring for example to FIG. 3, the printer 40 has on a Y2 side the paper roll holder 51 for holding the paper roll 10, with a printing head 52 and a platen roller 53 positioned at a point further in the Y1 direction than the paper roll holder 51. The printer 40, as shown in FIGS. 3 and 5, is accommodated within the space 42 described above. The paper roll holder 51 is positioned at the front 43 of the device 41 and the printing head 52 and the platen roller 53 are positioned inside the device 41, such that the front opening 44 described above is covered and at the same time the paper roll holder is formed when a lid 55 is closed.

Additionally, the printer 40 has a frame 50, a paper roll holder base 54, a lid 55 and a top cover 56.

The frame 50 is positioned at a portion of the Y1 side. On the frame 50 are provided, at a point approximately midway in a height direction of the device 41, that is, in the Z1–Z2 direction, the above-noted printing head 52, the rubber platen roller 53, rear and front paper guides 60 and 61, respectively, and a rubber feed roller 62. The printing head 52 has resistive heating elements 63 and two sensors S1, S2 for optically detecting paper, and further, a flexible cable 65 is extended from the printing head 52.

Figure 6:
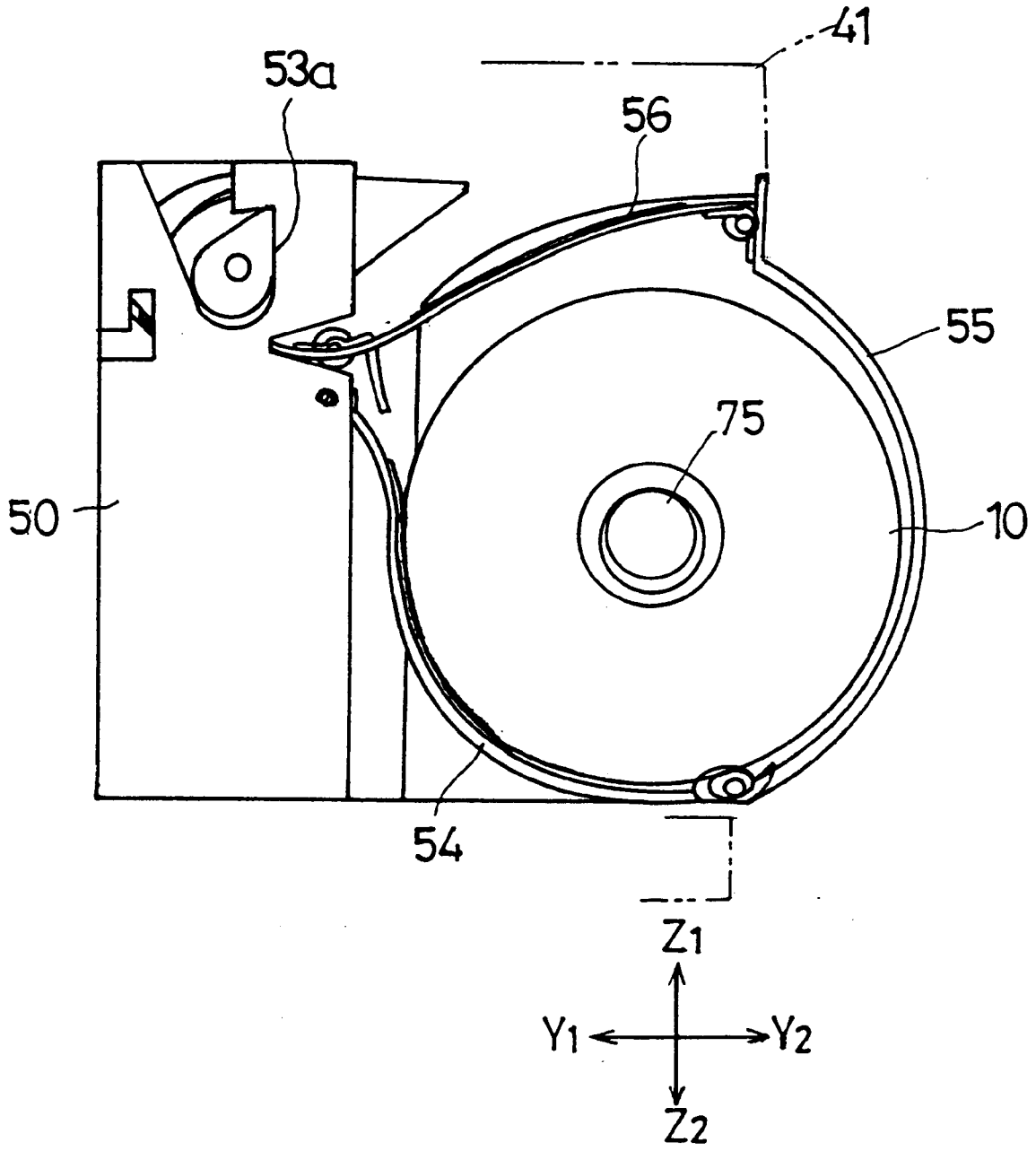
FIG. 6 is a diagram showing a cross-sectional view of the printer of FIG. 3 along the line VI—VI shown in FIG. 4.

The printing head 52 is mounted on the frame 50 via a supporting plate 66 and is urged by a pressure spring 67 so that the resistive heating elements 63 is pressed against the platen roller 53. As shown in FIG. 6, both ends of the platen roller 53 are supported by shaft bearings 53*a*. Together, the printing head 52 and the platen roller 53 form a printing mechanism member 100.

Additionally, the sensors S1 and S2 are positioned in the X1 and X2 directions, respectively, opposite a cutter on a front edge of the top cover 56 to be described later. The rear paper guide 60 is positioned so as to cover a portion of the platen roller 53 from a Y1 side to a Z1 side thereof. The front paper guide 61 is a bar member with a substantially triangular cross-section, the apex of the triangle pointing in a Y2 direction, and is positioned so as to cover a portion of the platen roller 53 extending from a Y2 side to a Z2 side thereof. Additionally, a rib 61*b* is formed on a horizontal upper surface 61*a* in order to prevent the paper from sticking to the top of the front paper guide 61.

Additionally, as shown in FIG. 7, grooves 68, 69 for guiding the top cover into a position on an X1 side and a position on an X2 side are provided on the frame 50, at a position intermediate between a position of an X1 side and a position of an X2 side thereof, near the feed roller 62.

Additionally, a stepping motor 70 is provided on a portion of a bottom side of the frame 50. The stepping motor 70 rotates the platen roller 53 and the feed roller 62 via the gears in a gearbox 71.

As shown in FIG. 5, the paper roll holder base 54 is formed substantially in the shape of an L, and has a vertical plate member 54*a* and a horizontal plate member 54*b*. A paper guide 54*d* is provided on a top edge of the vertical plate member 54*a*. The paper guide 54*d* is fixedly mounted on the frame 50. The vertical plate 54*a* extends along a front surface of the frame 50 and the horizontal plate member 54*b* extends to the position of the front opening 44 described above, in the Y2 direction in a height of a lower edge of the frame 50. The paper guide 54*d* is positioned at an entrance ENT opposite a location at which the platen roller 53 and the resistive heating elements 63 contact each other.

Additionally, on an interior surface of the paper roll holder base 54 a rib 54*c* is formed to prevent the paper from sticking to the interior surface of the paper roll holder base 54.

Additionally, the feed roller 62 described previously projects from an opening 54*a*1 in a top edge of the vertical plate member 54*a*. Further, as shown also in FIGS. 9A, 9B and 9C, apertures 54*d*1, 54*d*2 are formed in left and right side portions of the paper guide 54*d* so as to be disposed opposite sensors S1, S2 described above.

The lid 55 has a size identical to a size of the above-described front opening 44, and is rotatably connected by a hinge 73 to a front edge of the horizontal plate member 54*b* of the paper roll holder base 54. As shown in FIGS. 3 and 5, the lid 55 closes an entry 51*a* to the paper roll holder 51 when in a vertical position and opens the entry 51*a* when rotated clockwise about the hinge 73. Additionally, when the lid 55 is rotated to substantially a horizontal position as shown in FIGS. 7 and 8 the lid 55 a stopper mechanism (not shown in the diagram) that forms a part of the hinge 73 prevents the lid from rotating further and retains the lid 55 in that substantially horizontal position. The lid 55 so supported in that substantially horizontal position performs the task of supporting the paper roll 10 loaded therein. Additionally, it can be appreciated that the lid 55 has a bulge 55*a* that follows the contour of the paper roll 10. Additionally, a side panel 74 is provided at an X1 side of the lid 55. A base of a paper roll 10 supporting rod 75 is fixedly mounted on the side panel 74 so as to project in the X2 direction. An X2 side of the lid 55 has no side panel and is open.

A base side of the top cover 56 described previously is rotatably connected to the front edge of the lid 55 by a hinge 76. A clockwise rotation of the top cover 56 is restricted at a position substantially vertical with respect to the lid 55 by a stopper mechanism (not shown in the diagram) that forms a part of the hinge 76. A counter-clockwise rotation of the top cover 56 is enabled up to a position at which the top cover 56 rests atop the lid 55 as shown by the dotted lines in FIG. 8, while a clockwise rotation of the top cover 56 is enabled up to a position substantially vertical with respect to the lid 55.

Hereinafter, the substantially vertical position of the top cover 56 with respect to the lid 55 is referred to as an upper position, while the position of the top cover 56 resting substantially atop the lid 55 as shown by the dotted lines in FIG. 8 is referred to as a lower position. It should be noted that the top cover 56 is rotatably urged clockwise by the force of a torsion coil spring 77 included in the hinge 76 so as to be positioned at the upper position.

A cutter composed of a blade 56*a* is provided on a front edge of the top cover 56, the blade 56*a* being disposed at an angle to the X1–X2 axis, that is, slanted with respect to a direction in a width of the paper unraveled from the paper roll, in order to facilitate cutting of the paper.

Additionally, positioning tabs 56*b*, 56*c* that engage the grooves 68, 69 for guiding the top cover into position described above are provided at both sides of the front edge of the top cover 56. The front edge of the top cover 56 is also provided with a tab 56*d* to prevent the paper from curling back into the interior of the paper roll holder 51. Additionally, a rib 56*e* is formed on a top surface of the top cover 56 to prevent the paper from sticking thereto.

Additionally, a paper press roller 78 made of rubber is supported at both ends of a shaft thereof by leaf springs 79 and disposed so as to engage an opening 56*f* in the top cover 56.

The above-described frame 50, the paper roll holder base 54, the lid 55 and the top cover 56 are together constructed so that when the front edge of the lid 55 is pulled in the Y2 direction the lid 55 is opened as shown in FIGS. 7 and 8, the substantially rectangular opening 44 provided on the front 43 of the device 41 is opened, the top cover 56 comes out of the device 41 and the paper roll holder 51 is opened.

Additionally, the frame 50, paper roll holder base 54, lid 55 and top cover 56 are constructed so that, in the state shown in FIGS. 7 and 8, by rotating the lid so as to lift the front edge thereof upward, the lid 55 assumes a vertical position as shown in FIGS. 3 and 4 and the front opening 44 closes, the top cover 56 passes through the front opening 44 and enters the interior of the paper roll holder 51 and is positioned under the front paper guide 61 and is further positioned above the horizontal plate 54*b* of the paper roll holder base 54 so as to confront the paper guide 54*d*, thus forming the paper roll holder 51. A paper feed path 80 is formed between the front paper guide 61 and the top cover 56.

In a final stage in which the lid 55 is closed, the positioning tabs 56*b*, 56*c* described above, are engaged, guided and positioned by the grooves 68, 69 for guiding the top cover into position as described above, thus positioning the front edge of the top cover 56 in place. At this time, as shown in FIG. 5 the blade 56*a* is positioned beneath the platen roller 53 and beneath the Z2 side front edge of the front paper guide 61. The result is that the blade 56*a* is accurately positioned at a point just above the paper guide 54*d* of the vertical plate member 54*a*, with a slight gap provided between the blade 56*a* and a top of the paper guide 54*d*.

Figure 9A:
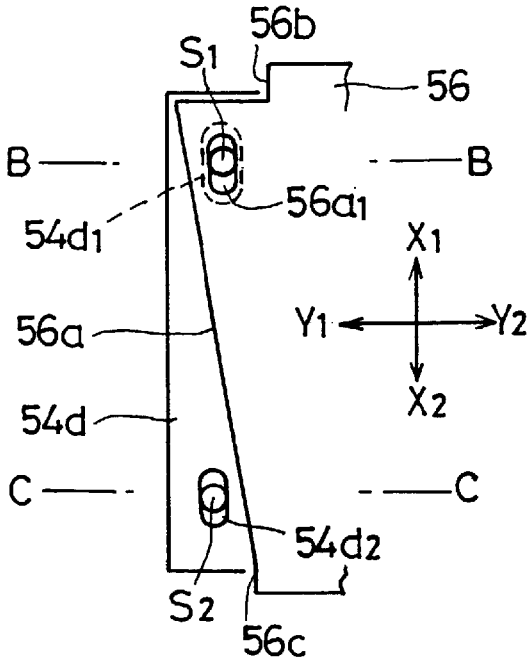
FIGS. 9A, 9B and 9C are diagrams showing the position of the cutter in the printer with respect to the sensor in the state shown in FIGS. 4 and 5.
Figure 9B:
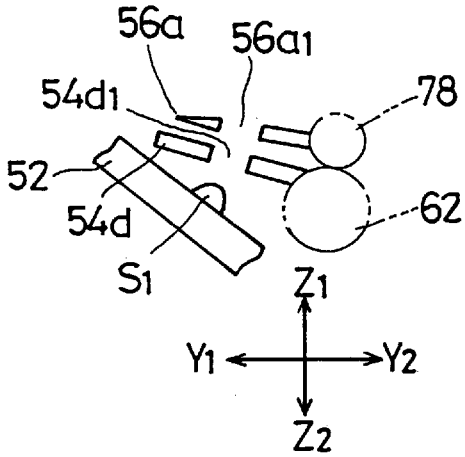
Figure 9C:
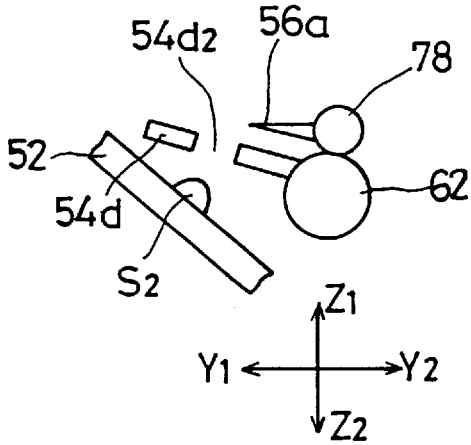

Accordingly, the blade 56*a* is positioned just in front of a point, with respect to the paper feeding direction, at which the resistive heating elements 63 and the platen roller 53 contact each other so as to perform printing, that is inside the printing mechanism member 100. At this time, as shown in FIGS. 9A, 9B and 9C, opening 56*a*1 is disposed opposite sensor S1, with the portion that corresponds to the sensor S2 disposed further back from sensor S2 in the Y2 direction.

Additionally, the positioning in place of the top cover 56 causes the paper press roller 78 to press against the feed roller 62, and further causes the tab 56*d* to be disposed opposite a Y2 side of the feed roller 62.

Additionally, as shown in FIG. 5, the printing head 52 is driven by a printing head drive circuit 90 and the stepping motor 70 is driven by a stepping motor drive circuit 91, with each of the drive circuits 91, 92 controlled by a control circuit 93.

A description will now be given of an operation of loading the paper roll 10 into the above-described printer 40.

The printer 40 is in the state shown in FIG. 3 prior to loading the paper roll 10.

The loading of the paper roll 10 is completed when an operator performs the following five steps and the paper is fed onward automatically.

The steps performed by the operator are as follows:

(1) Opening the lid 55.

The operation of opening the lid 55 involves rotating the lid 55 forward to the position shown in FIGS. 7 and 8, so that the entrance 51*a* to the paper roll holder 51 is open.

It should be noted that a spring is included in the hinge 73, such that when the lid 55 presses a lock mechanism connected to the lid 55 the lock is released, so that the operator can open the lid 55 with a light push.

In a state in which the lid 55 is open, the supporting rod 75 projects beyond an outside of the paper roll holder 51. Accordingly, a tip portion 75*a* of the supporting rod 75 is not covered but remains exposed.

(2) Unraveling the paper roll along the dotted line to the position shown by reference number 11. The length to which the paper roll 10 is unraveled is, for example, approximately 10 cm, which is a length at which the paper extends along the paper feed path 80 up to an outside of the printer 40 in a state in which the paper roll 10 is loaded in the paper roll holder 51.

(3) As shown in FIG. 7, pressing the paper roll 10 onto the lid 55 from the X2 side of the lid 55, engaging a cylindrical core 13 of the paper roll 10 with the supporting rod 75 so as to support the core 13 of the paper roll 10 with the supporting rod 75. The unraveled portion 11 of the paper roll 10 covers the top of the top cover 56.

In order to support the paper roll 10 with the supporting rod 75 it is sufficient to push the paper roll 10 in the X1 direction until the paper roll 10 contacts the side panel 74. No fine repositioning of the paper roll 10 is required.

(4) Lifting the front edge of the lid 55 up and rotating the lid approximately 90 degrees so as to close the lid.

Figure 10:
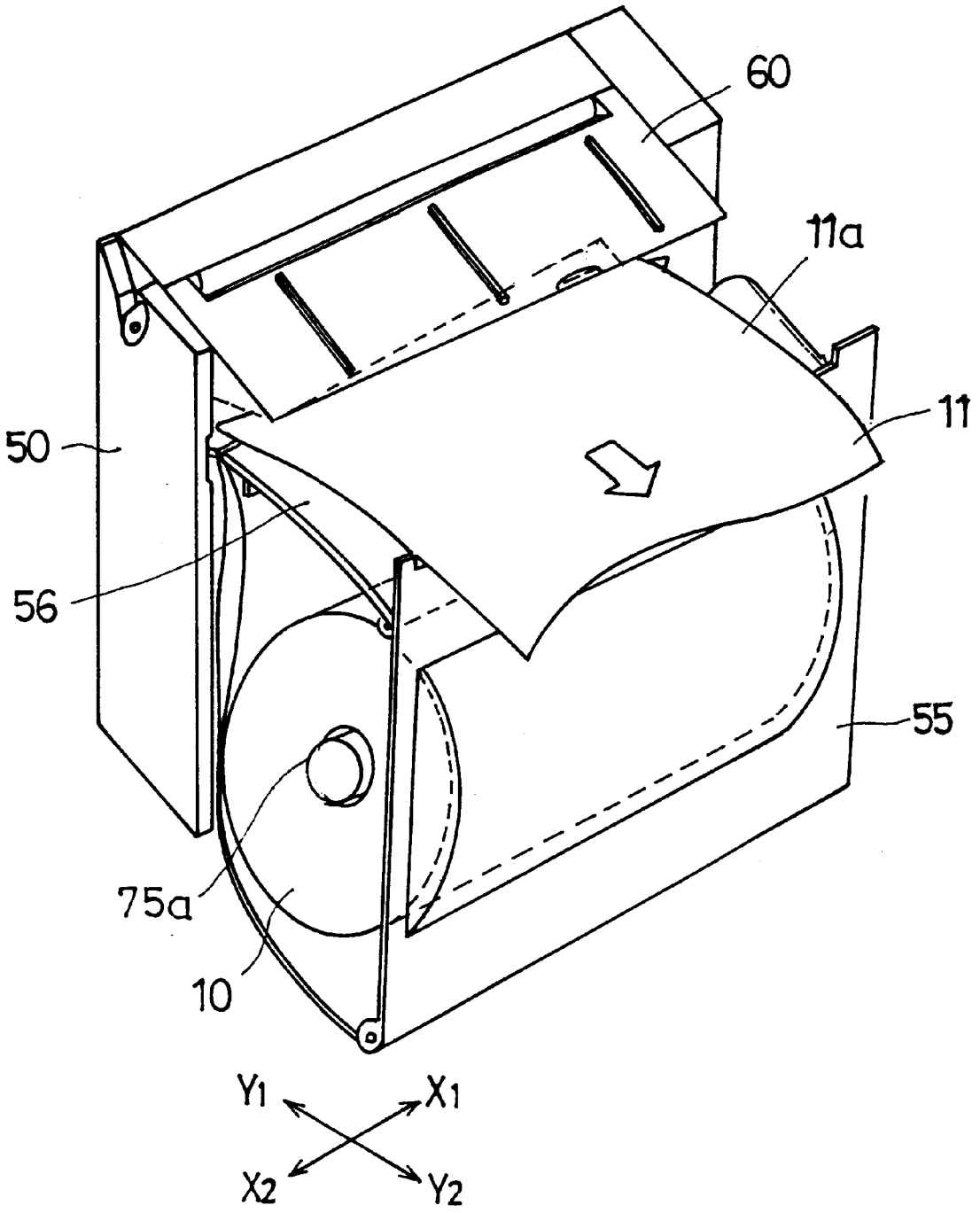
FIG. 10 is a diagram showing a state in which the paper roll is set to the supporting rod and the cover closed.

After this operation is completed, the printer 40 is in the state shown in FIG. 10.

As shown in FIG. 10, the paper roll 10 is moved together with the lid 55, inserted into the interior of the paper roll holder 51, and brought into proximity to the paper roll holder base 54. The lid 55 is then closed, and the top cover 56 enters the interior of the paper roll holder 51 so as to cover a top of the paper roll 10. In the process of the top cover 56 entering the interior of the paper roll holder 51 the paper 11 unraveled from the paper roll 10 is bent back by and at the blade 56*a*, entering the paper feed path 80 described above.

The paper roll holder base 54, the lid 55 and the top cover 56 together form the paper roll holder 51, in which is contained the paper roll 10 supported by the supporting rod 75. The tip 75*a* of the supporting rod 75 projecting beyond an X2 edge of the paper roll 10 is supported by a bearing mounted on the frame 50 though not shown in the drawings, such that the supporting rod 75 is supported at both ends so as to more firmly support the paper roll 10.

Figure 11A:
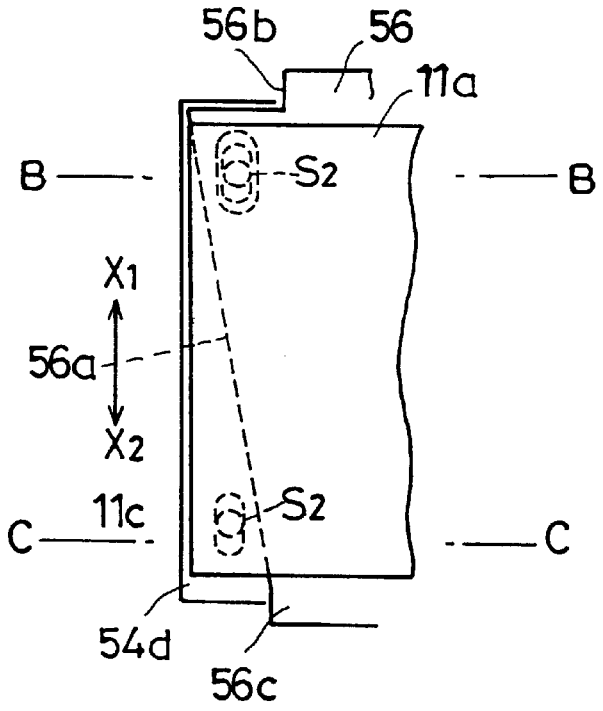
FIGS. 11A, 11B and 11C are diagrams showing the state of the paper at the cutter shown in FIG. 10.
Figure 11B:
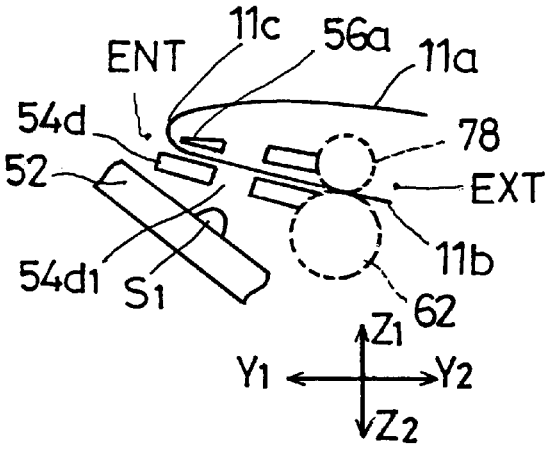
Figure 11C:
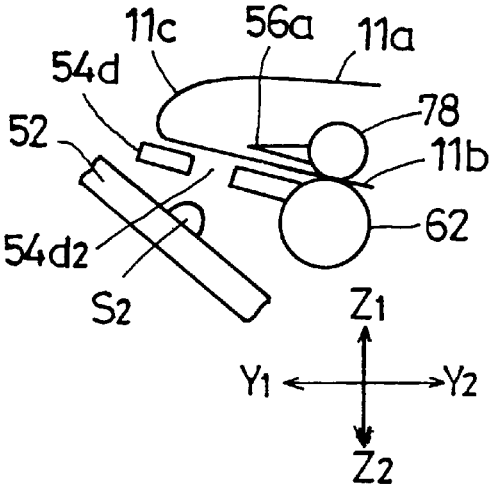

As shown in FIGS. 11A, 11B and 11C, the portion 11 unraveled from the paper roll 10 is sandwiched between the feed roller 62 and the paper press roller 78 at the exit of the paper roll holder 51 passes beneath the blade 56*a* and is bent back by the blade 56*a* and, as shown in FIG. 11B and as described above, extends over the top of the top cover 56 in the Y2 direction through the paper feed path 80 and projects beyond the edge of the printer 40.

(5) Pulling in the Y2 direction the unraveled portion 11 of the paper roll 10 projecting beyond the side of the printer 40 and cutting the paper 11 at the blade 56*a*.

Figure 12:
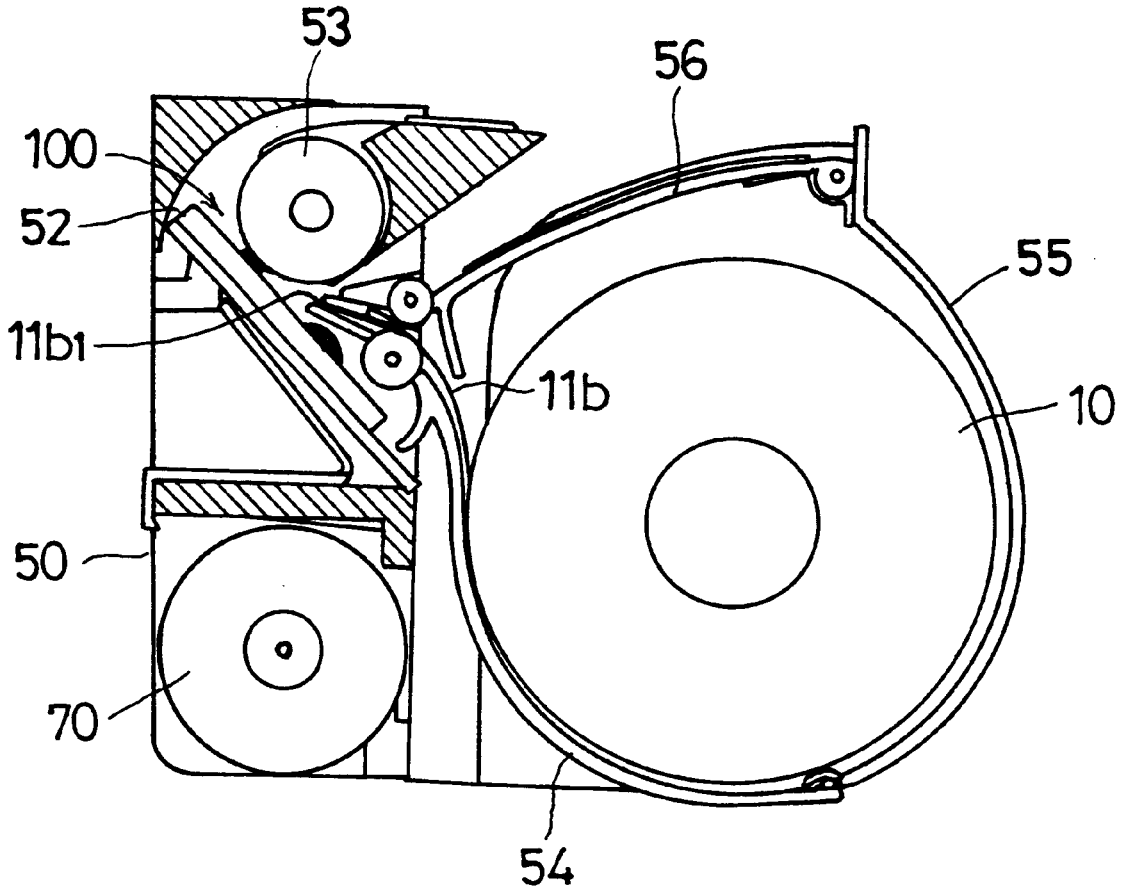
FIG. 12 is a diagram showing a state of the printer immediately after the paper has been cut.

At this point, the printer 40 is in the state shown in FIG. 12.

Figure 13A:
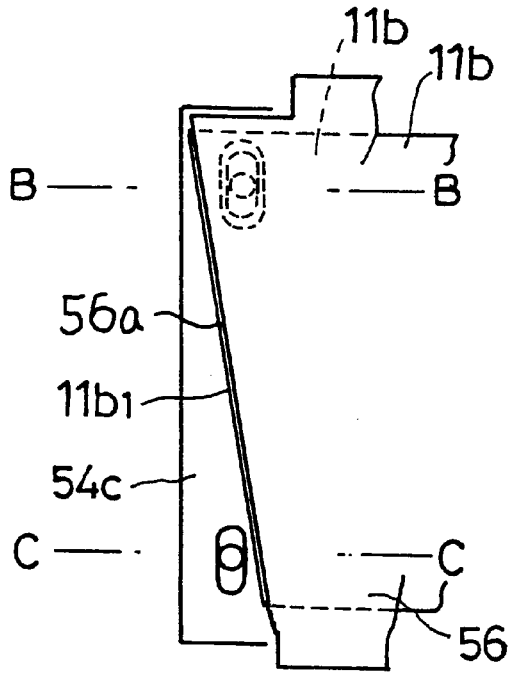
FIGS. 13A, 13B and 13C are diagrams showing a state of the paper at the cutter shown in FIG. 12.
Figure 13B:
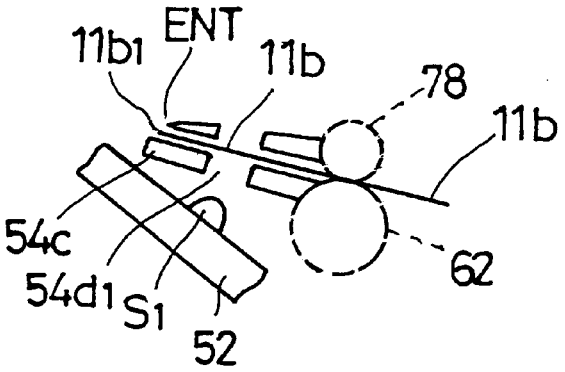
Figure 13C:
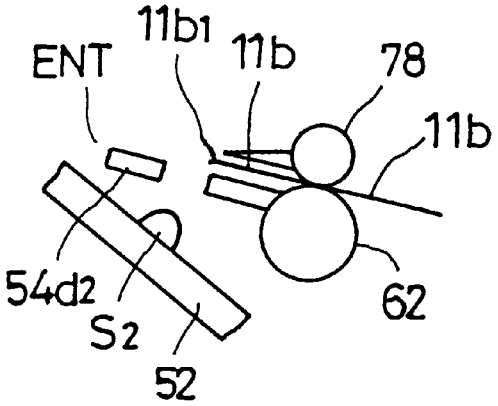

The portion 11 of the paper roll 10 is bent back by and at the blade 56*a* and sandwiched between the feed roller 62 and the paper press roller 78 at the exit of the paper roll holder 51, so if the portion 11 of the paper roll 10 extending beyond the edge of the printer 40 is pulled in the Y2 direction it is cut by and at the blade 56*a*. As a result, a portion of paper 11*a* in the paper feed path 80 beyond the cutter 56*a* is removed while a portion of paper 11*b* between the blade 56a and the paper roll 10 itself remains, a leading edge 11*b*1 of this latter portion being supported by a narrow portion between the paper guide 54*d* and the blade 56*a* and positioned at an entrance to a position at which printing is performed as shown in FIGS. 13A, 13B and 13C.

The portion of paper 11*a* that is cut and pulled from the printer 40 is discarded because this portion 11*a* has a glue that originally kept the paper roll 10 from unraveling, as the outermost layer of the paper roll 10 is frequently dirty and, if not dirty, is nevertheless often sullied by the operation of unraveling from the paper roll 10.

The operations described above complete the task of loading the paper roll 10 in the paper roll holder 51.

The feeding onward of the paper is performed automatically. More specifically, the control circuit 93 activates the stepping motor circuit 91, the stepping motor 70 drives through a certain number of steps, the paper 11*b* is fed between the platen roller 53 and the resistive heating elements 63 by the feed roller 62 to a position such that the leading edge 11*b*1 of the paper is positioned atop the platen roller 53. A more detailed description of this automatic paper feed operation is given later.

Figure 14:
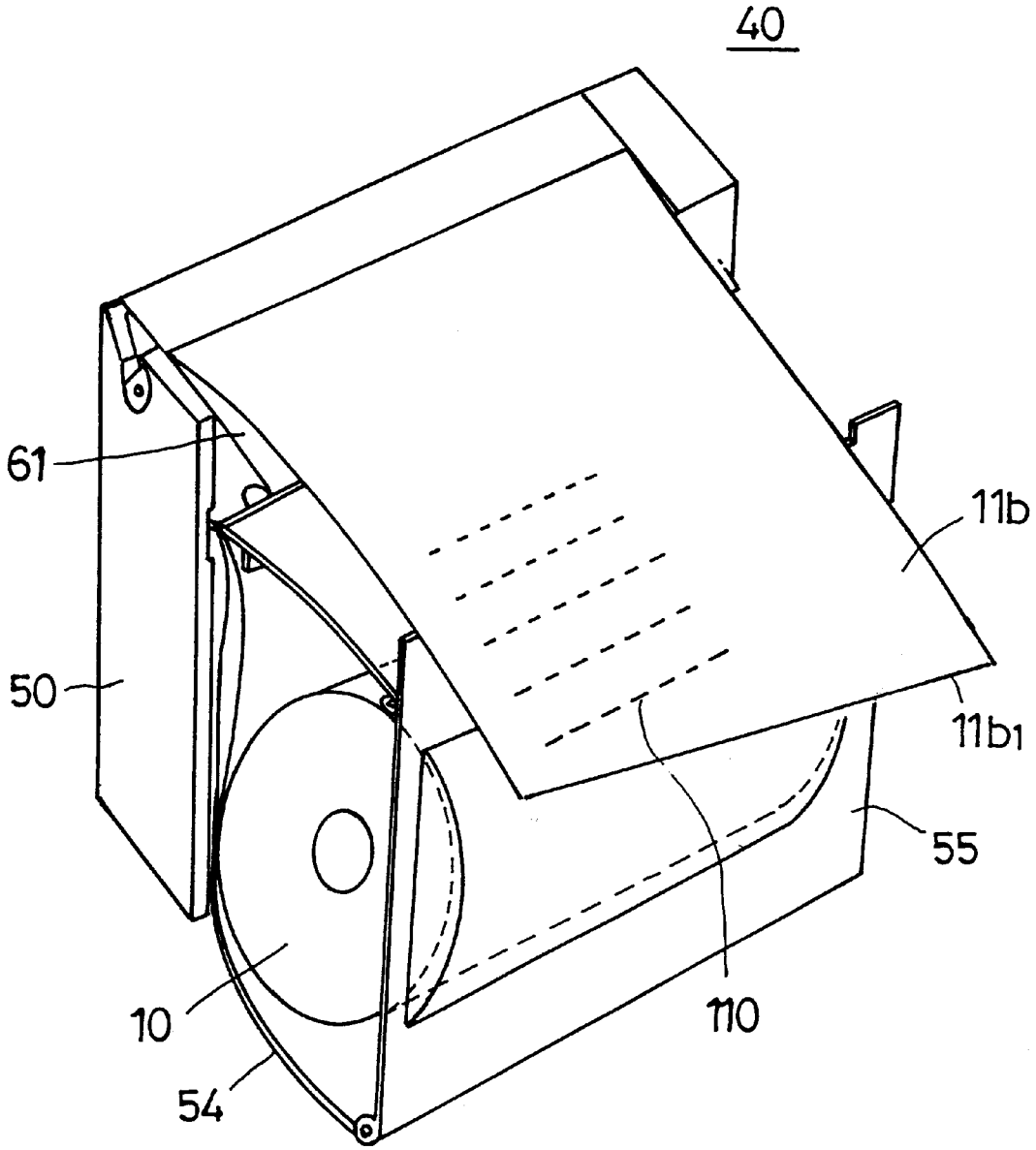
FIG. 14 is a diagram showing a state after printing has commenced.

The operations described above complete the loading of the paper roll 10 into the printer 40. By pressing the print button the stepping motor drive circuit 91 and the printing head drive circuit 90 are activated by the control circuit 93, the paper 11*b* is pulled from the paper roll 10 by the feed roller 62, the paper 11*b* is printed by the printing head 52, the paper 11*b* with printing thereon indicated in FIG. 14 by reference number 110 is fed by the platen roller 53, guided by the rear paper guide 60 in the Y2 direction and, as shown in FIG. 14, fed to the outside of the printer 40. It will be noted that the leading edge 14*b*1 is slanted, having been cut at a diagonal by the blade 56*a*.

A description is now given of certain aspects and advantages of the operation of loading the paper roll 10 not fully explained in the foregoing description.

(1) Operation is simple and easy.

Operations 1, 2, 3, 4, and 5 described above are not complicated operations and do not require precise manipulation, and accordingly can be performed in, for example, cold-weather conditions in which the operator is required to wear gloves. As can be appreciated, it is thus possible to load the paper roll 10 into the printer 40 simply and easily.

(2) There is no danger that the printing head 52, platen roller 53 and feed roller 62 will be dirtied.

The feed roller 62 is positioned within the paper roll holder 51, and the printing head 52 and platen roller 53 are positioned even further inside the paper roll holder 51. Accordingly, the operator's hands do not contact the feed roller 62, the printing head 52 and the platen roller 53 during the operations 1, 2, 3, 4, and 5 described above.

As described previously, the portion 11 of paper unraveled from the paper roll 10 is bent backward by and at the blade 56*a* and inserted into the paper feed path 80, so the portion 11 of paper unraveled from the paper roll 10 does not contact either the printing head 52 or the platen roller 53. Accordingly, the action of unraveling the portion 11 from the paper roll 10 does not dirty either the printing head 52 or the platen roller 53 even if the portion 11 happens to be dirty.

(3) The cutting of the portion 11 of paper unraveled from the paper roll 10 is accomplished smoothly and efficiently, with a minimum of force, for the following four reasons:

First, in the state shown in FIGS. 10, 11A, 11B and 11C, the portion 11 of paper unraveled from the paper roll 10 is sandwiched between the feed roller 62 and the paper press roller 78, so that when the portion of paper 11 is pulled in the Y2 direction tension arises therein.

Second, a bent-back portion 11*c* of the portion 11 of paper unraveled from the paper roll 10 extends latitudinally in the X1–X2 direction while the blade 56*a* of the cutter lies at an angle with respect to the line X1–X2. Accordingly, when the portion of paper 11 is pulled in the Y2 direction the portion of paper 11 begins to be cut from an X1 edge thereof gradually toward an X2 edge thereof, with cutting completed at the X2 edge. That is, the cutting of the portion of paper 11 is a succession of points that moves gradually latitudinally. Accordingly, at any given moment the above-described tension exerted in the Y2 direction on the portion of paper 11 is concentrated at a single point. As a result, cutting is accomplished more smoothly, more easily and with less force than is the case when the blade of the cutter is disposed perpendicular to the X1–X2 direction.

Third, the positioning tabs 56*b*, 56*c* that engage the grooves 68, 69 for guiding the top cover into position described above also firmly position the blade 56*a* in place.

Fourth, the presence of the rib 56*e* is on the top surface of the top cover 56 to prevent the paper from sticking thereto causes the paper to float slightly above the top surface of the top cover 56. As a result, neither the formation of condensation on the top cover 56 nor the presence of a static electric charge on the paper causes the paper to stick to the top of the top cover 56. Therefore when the portion 11 of paper unraveled from the paper roll 10 is pulled in the Y2 direction the force of that tension is directly transmitted to the point at which the blade 56*a* contacts the portion of paper 11.

(4) There is no need to manually feed the paper to the printing mechanism.

The cutting of the portion 11 of paper unraveled from the paper roll 10 is detected and the feeding of the cut portion of paper 11 to the printing mechanism is performed automatically in response to that detection. As a result, the need to feed the portion of paper 11 to the printing mechanism by hand is eliminated and operation is simplified accordingly.

(5) The paper is fed through the printing mechanism firmly and accurately, for the following three reasons:

First, the leading edge 11*b*1 of the paper 11 retains its stiffness, facilitating the accuracy with which it is fed onward.

Second, as shown in FIGS. 12 and 13A, 13B and 13C, the positioning tabs 56*b*, 56*c* that engage the grooves 68, 69 guide the front edge of the top cover 56 and thus the blade 56*a* mounted on the front edge of the top cover 56 firmly and accurately into position, the paper feed roller 78 is accurately pressed by the feed roller 62.

Third, as shown in FIGS. 13A, 13B and 13C, the leading edge 11*b*1 of the paper 11 is held between the paper guide 54*d* provided on the top edge of the vertical plate member 54*a* and the blade 56*a* and positioned at the entrance to the printing mechanism.

The core 13 of the paper roll 10 can be removed easily.

In a case in which the supporting rod 75 is not provided, the cylindrical core 13 gradually recedes into the interior of the paper roll holder 51 as the paper roll 10 is used and can be difficult to remove when the time comes to insert a new roll of paper 10.

However, the present embodiment uses the supporting rod 75 described above to support the core 13, eliminating the above-described disadvantage. More specifically, with the lid 55 open the core 13 projects beyond the exterior of the paper roll holder 51, and so can be easily removed whether the roll of paper 10 is completely used or some portion of paper still remains wound around the core 13.

A description will now be given of an operation of feeding the paper onward.

As shown in FIGS. 9A, 9B and 9C, the sensors S1, S2 described above are each composed of a light-emitting element and a light-receiving element disposed opposite each other. In a state in which the light-emitting and light-receiving elements receive no light a "0" is output, and in a state in which the light-emitting and lightreceiving elements receive light a "1" is output.

Before the paper roll 10 is loaded into the printer 40, the output of both sensors S1, S2 is "0".

The paper roll 10 is then placed in the paper roll holder 51, with the portion of paper 11 projecting beyond the exterior of the printer 40 as shown in FIGS. 10, 11A, 11B, 11C. In such a state, the paper 11 covers the sensors S1, S2, the light-receiving element receives light emitted from the light-emitting element and reflected by the paper 11, and the output from both sensors S1, S2 is "1".

When the portion 11 of paper unraveled from the paper roll 10 is cut, the part of the paper 11 covering the sensor S2 is removed and the output of sensor S2 is "0". The portion of the paper 11 opposite the sensor 1 remains in place, so the output of sensor S1 remains "1".

Figure 15:
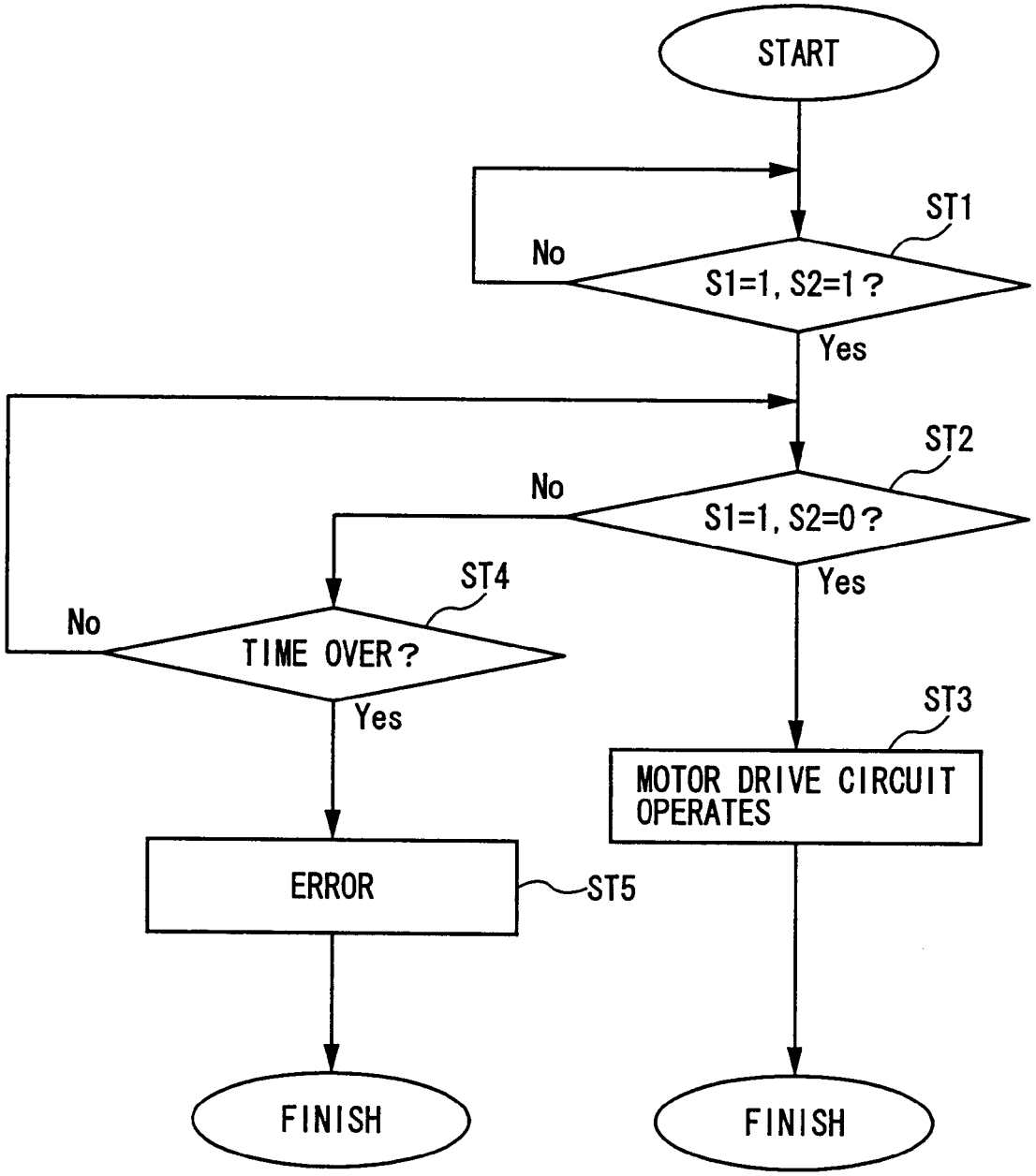
FIG. 15 is a flow chart showing operations performed by a microprocessor forming a control circuit.

The control circuit 93 shown in FIG. 5 comprises a microprocessor that performs the steps shown in FIG. 15, of which a description will now be given.

In a step ST1, the microprocessor determines whether or not the output from both sensors S1, S2 is "1". If the answer is "yes" then in a step ST2 the microprocessor determines when the output from sensor S2 turns "0". If it is determined in step ST2 that the output from sensor S2 is "0" then the microprocessor activates the stepping motor circuit 91 in a step ST3. If on the other hand it is determined in step ST2 that the output from the sensor S2 is not "0" then the microprocessor determines in a step ST4 whether or not a certain amount of time has elapsed and, if so, outputs an error signal in a step ST5.

When the stepping motor drive circuit 91 is activated by the control circuit 93, the stepping motor 70 steps a certain number of steps, causing the feed roller 62 and the platen roller 53 to rotate. Initially, the feed roller 62 feeds the paper 11*b* left on the paper roll 10 side to and into the printing mechanism member 100. Next, the paper 11*b* is picked up and fed onward by the feed roller 62 and the platen roller 53 together, so that the leading edge 11*b*1 of the paper 11*b* reaches and then stops at a position atop the platen roller 53. It should be noted that the platen roller 53 and the feed roller 62 rotate in synchrony.

A description will now be given of a state during printing.

As the platen roller 53 and the feed roller 62 rotate in synchrony, a speed with which the paper is fed by the feed roller 62 is slightly slow than a speed with which the paper is fed by the platen roller 53, so that the paper 11*b* is fed onward while being subjected to a tension between the feed roller 62 and the platen roller 53, thus providing high-quality printing by the printing head 52 as shown by reference numeral 110.

As described above, the rib 61*b* is provided on the top of the front paper guide 61, so the paper is raised slightly above the top of the front paper guide 61. As a result, neither the formation of condensation on the front paper guide 61 nor the presence of a static electric charge causes the paper to stick to the top of the front paper guide 61, and thus the printed paper is transported smoothly, printed surface side up, in the Y2 direction.

When the paper is fed onward by the feed roller 62, the paper roll 10 rotates in the clockwise direction. However, it sometimes happens that static electricity causes the paper unraveled from the paper roll 10 to be dragged by the paper roll 10. In such cases, the paper unraveled from the paper roll 10 contacts the tab 56*d* to prevent the paper from curling back into the interior of the paper roll holder 51, thus lifting the paper from the paper roll 10 and preventing the paper from getting wound around the paper roll 10.

A description will now be given of a variation of a method for loading the paper roll 10. In this variation, there is no supporting rod 75 provided on the lid 55. In this case, the operator places the paper roll 10 so as to let the paper roll 10 drop into the paper roll holder 51 as indicated by arrow Q in FIG. 7. At this time the paper roll 10 extends over the top cover 56 and into the interior of the paper roll holder 51. When the paper roll 10 extends over the top cover 56, the top cover 56 is forced by the force of the torsion coil spring 77 to a lower position, thus blocking the paper roll 10 from unraveling prematurely. As a result, the loaded paper roll 10 is stopped by the top cover 56 and accommodated by the bulge 55*a* in the lid 55 now in an open state and firmly supported atop the lid. When the lid 55 is closed the paper roll 10 is moved in the Y1 direction and loaded in the paper roll holder 51.

Figure 16:
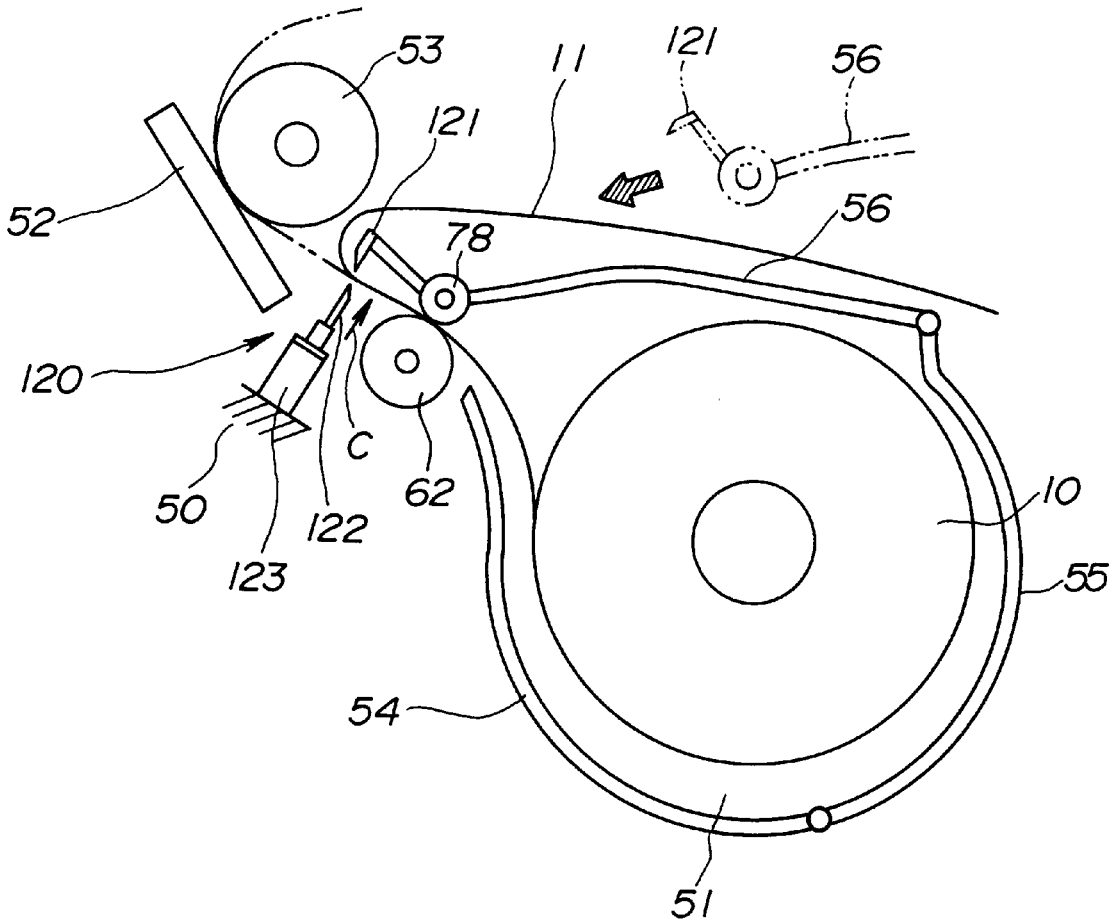
FIG. 16 is a diagram showing a variation of the cutter.

Additionally, an automatic cutter 120 as shown in FIG. 16 may be used in place of the manual paper cutting blade 56*a* shown in FIGS. 8, 9A, 9B and 9C. As shown in the diagram, the automatic cutter 120 comprises a fixed blade 121, a movable blade 122 and a plunger solenoid fixedly mounted on the frame 50 that moves the movable blade 122 in the direction of arrow C, and is disposed between the feed roller 62 and the platen roller 53. The fixed blade 121 is mounted on the front edge of the top cover 56, so that when the top cover 56 is closed the fixed blade 121 is disposed opposite the movable blade 122.

When it is detected that the top cover 56 is closed and that a paper roll 10 is loaded in the paper roll holder 51, the plunger solenoid 123 is activated and causes the movable blade 122 to intersect the fixed blade 121, thereby automatically cutting the portion 11 of paper unraveled from the paper roll 10.

A description will now be given of a printer according to a second embodiment of the present invention.

Figure 17:
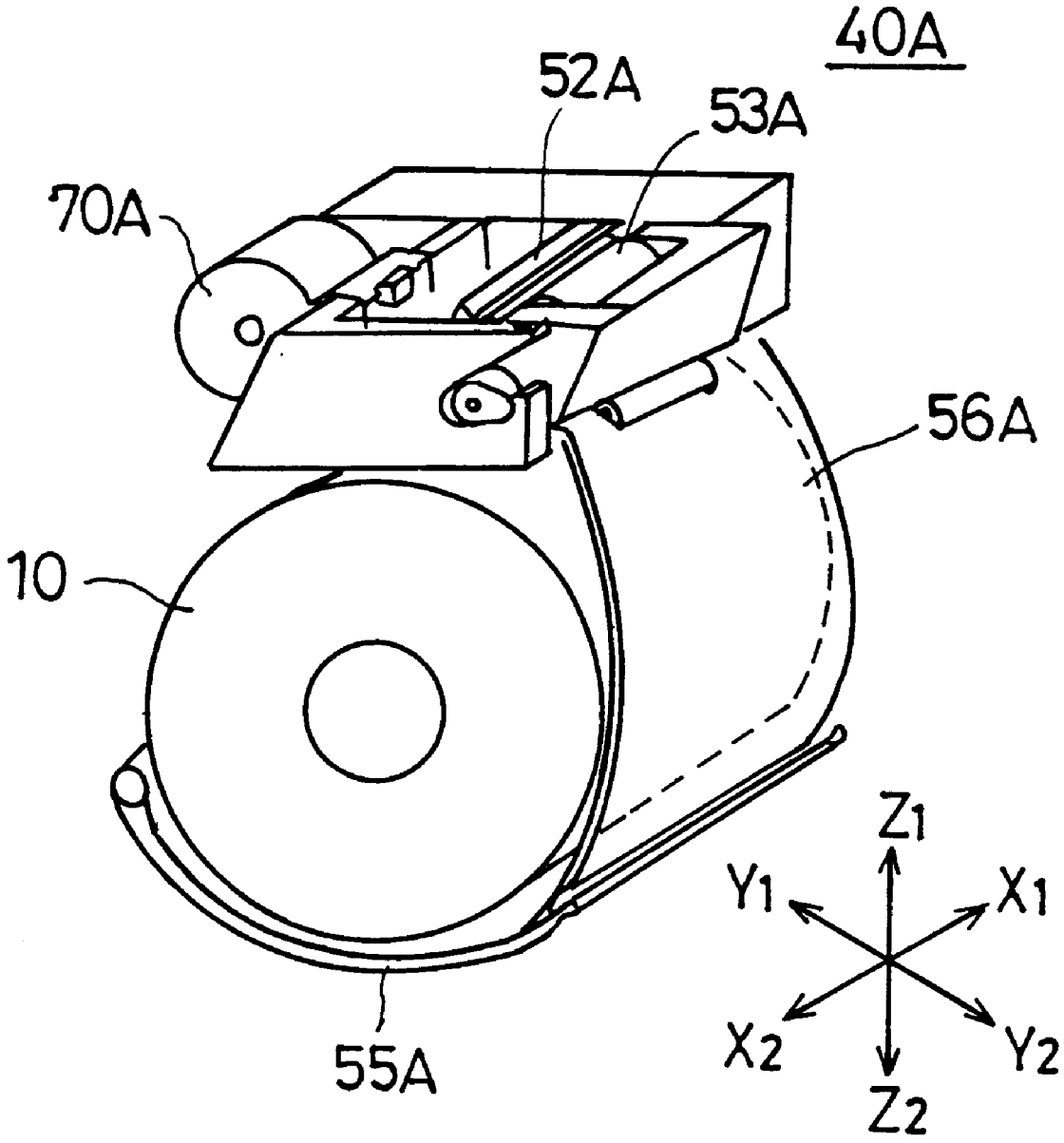
FIG. 17 is a diagram showing a perspective view of a printer according to a second embodiment of the present invention.
Figure 18:
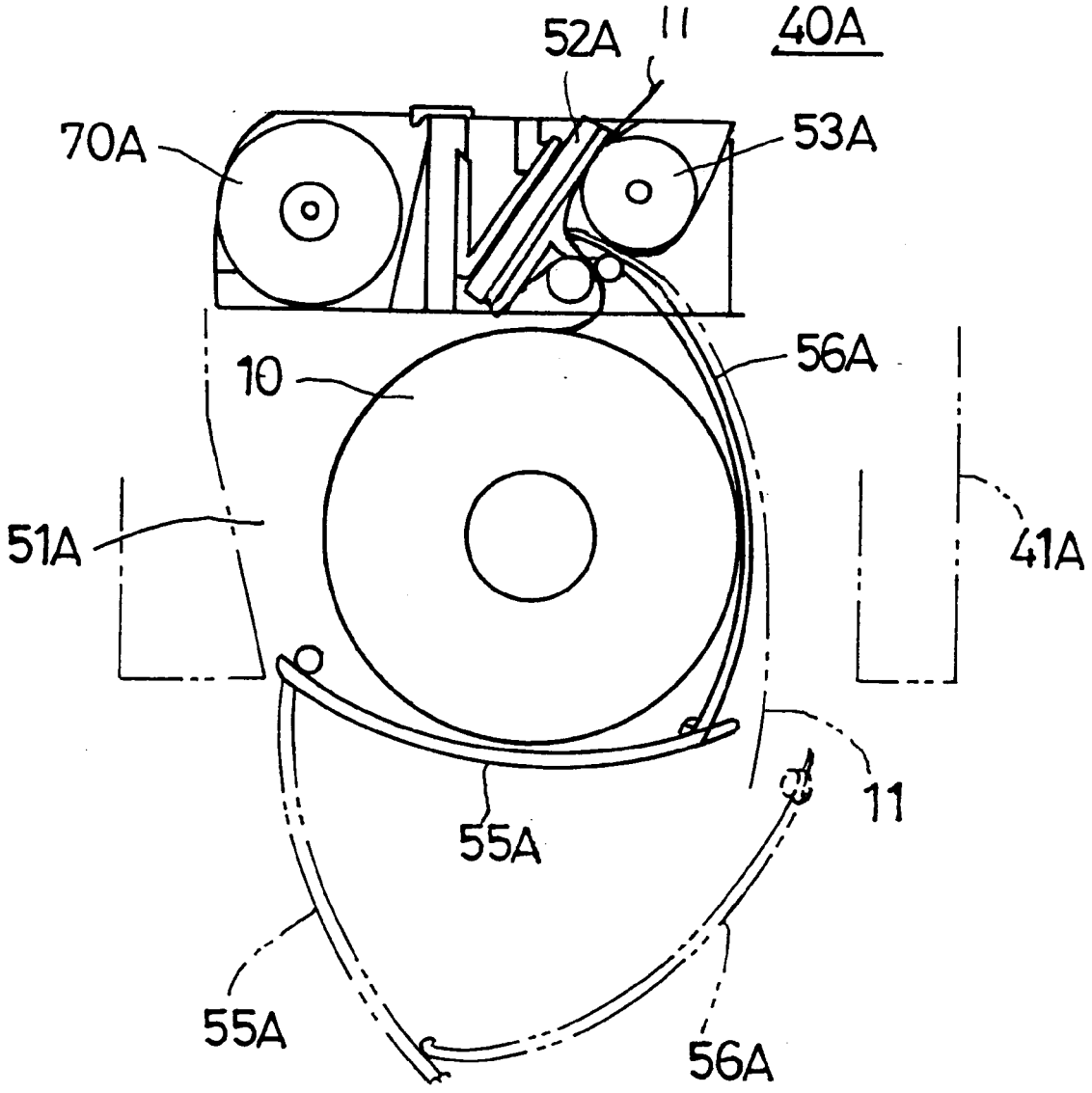
FIG. 18 is a diagram for the purpose of explaining the loading of a roll of paper to the printer shown in FIG. 16.

FIG. 17 is a diagram showing a perspective view of a printer 40A according to a second embodiment of the present invention. FIG. 18 is a diagram for the purpose of explaining the loading of a roll of paper to the printer shown in FIG. 16.

As shown in the diagrams, the printer 40A is loaded in a device 41A so that a lid 55A of the printer 40A is positioned on a bottom surface side thereof. The lid 55A thus opens downward, as shown by the double-dotted-and-dashed lines in FIG. 18. In a state in which the lid 55A is open, a paper roll 10 is loaded in a paper roll holder 51A from a bottom side of the printer 40A, with a portion 11 of paper unraveled from the paper roll 10 extending downward.

After the paper roll 10 is loaded into the paper roll holder 51A, the portion of paper 11 is pulled and cut and, as with the first embodiment, the paper is fed onward automatically and positioned in place.

A description will now be given of a printer according to a third embodiment of the present invention.

Figure 19A:
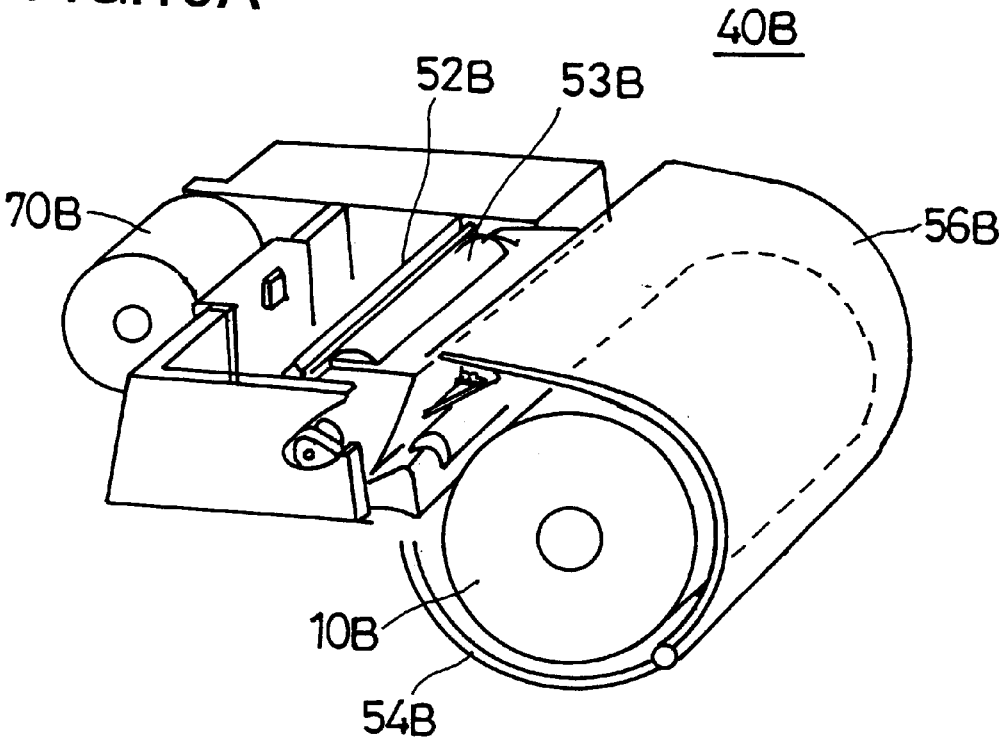
FIGS. 19A and 19B are diagrams showing a printer according to a third embodiment of the present invention.
Figure 19B:
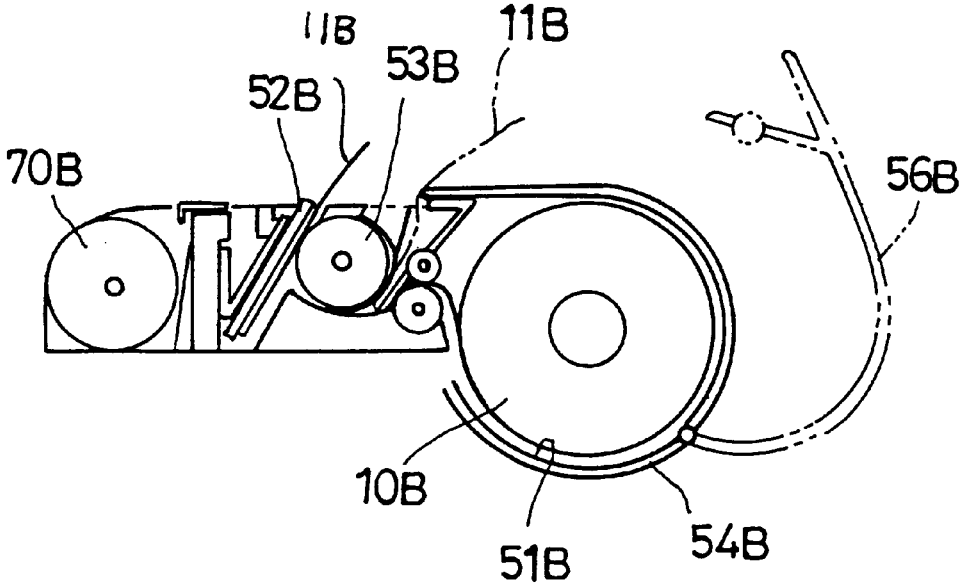

FIGS. 19A and 19B are diagrams showing a printer 40B according to a third embodiment of the present invention. As shown in the diagrams, the printer 40B is loaded with a small-diameter paper roll 10B. A top cover 56B is connected to a paper roll holder base 54B via a hinge. The top cover 56B opens to the position shown by the dotted lines in FIG. 19B, the paper roll 10 10B is dropped into position inside the paper roll holder 51B, the paper roll 10B is unraveled outward and the top cover 56B is closed, thereby loading the paper roll 10B.

After the paper roll 10B has been loaded into the paper roll holder 51B, the portion 11B of paper unraveled from the paper roll 10B is cut and, as with the previous embodiments, the paper is fed onward automatically and positioned in place.

A description will now be given of a printer according to a fourth embodiment of the present invention.

Figure 20A:
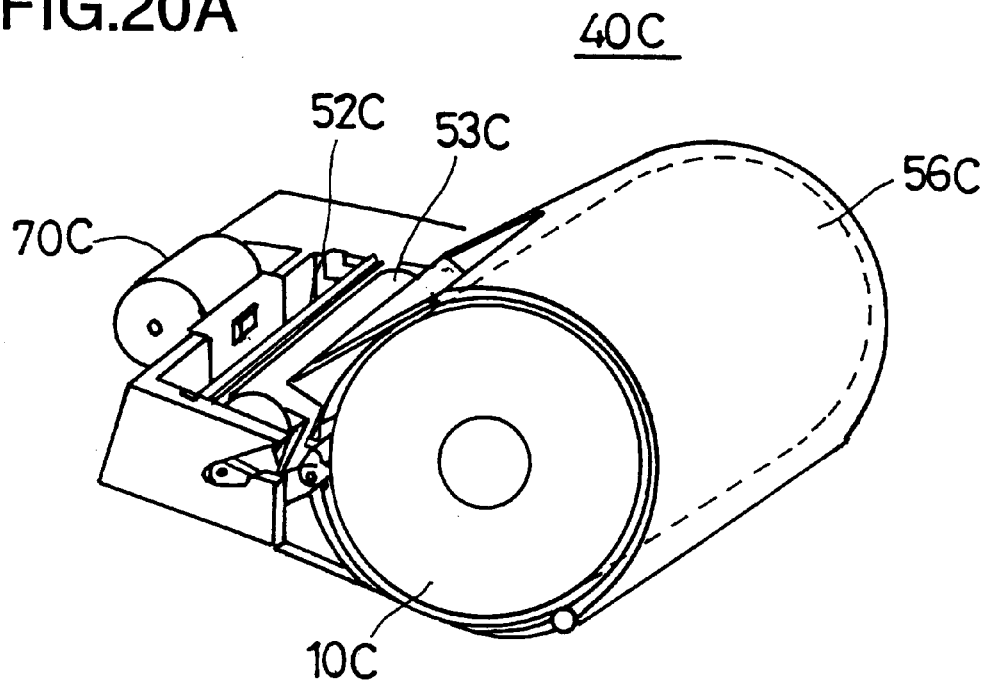
FIGS. 20A and 20B is a diagram showing a printer according to a fourth embodiment of the present invention.
Figure 20B:
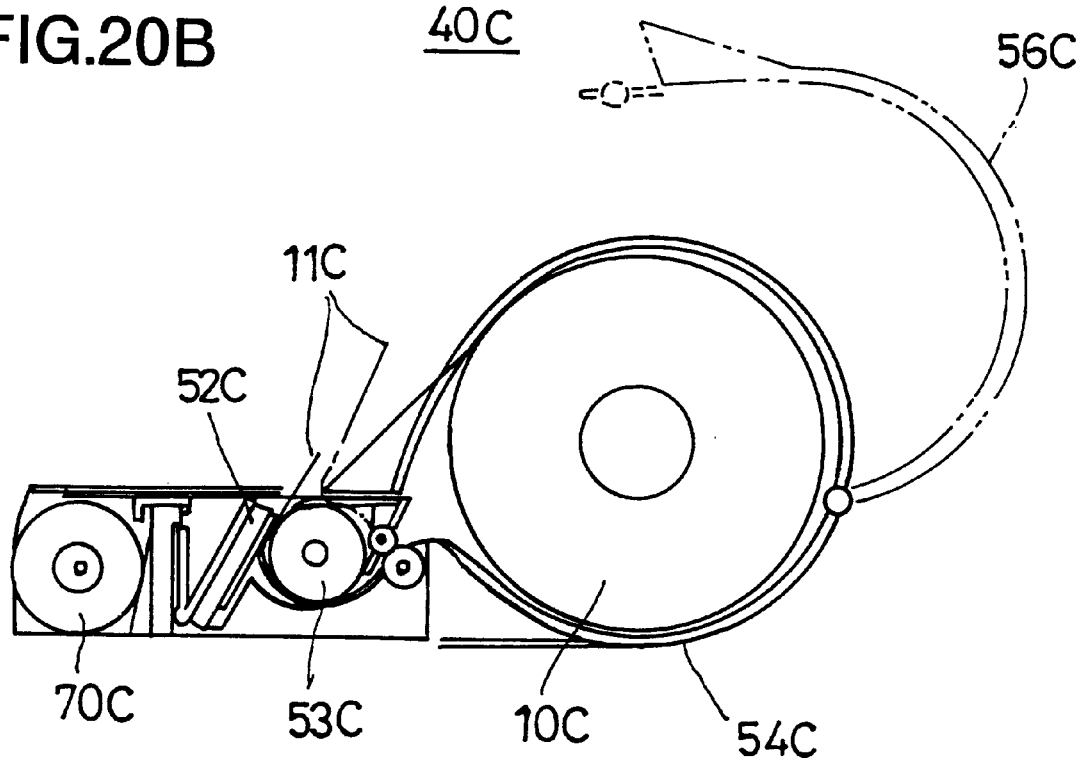

FIGS. 20A and 20B are diagrams showing a printer 40C according to a fourth embodiment of the present invention.

As shown in the diagrams, the printer 40C is loaded with a large-diameter paper roll 10C. A top cover 56C is connected to a paper roll holder base 54C via a hinge. The top cover 56C opens to the position shown by the dotted lines in FIG. 20B, the paper roll 10C is dropped into position inside the paper roll holder 51C, the paper roll 10C is unraveled outward and the top cover 56C is closed, thereby loading the paper roll 10C.

After the paper roll 10C has been loaded into the paper roll holder 51C, the portion 11C of paper unraveled from the paper roll 10C is cut and, as with the previous embodiments, the paper is fed onward automatically and positioned in place.

The above description is provided in order to enable any person skilled in the art to make and use the invention and sets forth the best mode contemplated by the inventors of carrying out their invention.

The present invention is not limited to the specifically disclosed embodiments, and variations and modifications may be made without departing from the scope and spirit of the present invention.

The present application is based on Japanese Priority Application No. 11-0365557, filed on Dec. 22, 1999, the entire contents of which are hereby incorporated by reference.

What is claimed is:

1. A printer, comprising:

a paper roll holder including a cover for holding a roll of paper when the cover is closed;

a paper feed path guiding the paper from the paper roll holder;

a printing head provided on a portion of the paper feed path for printing on the paper; and a cutter disposed on the paper feed path between the paper roll holder and the printing head for cutting an unraveled portion of the roll of paper being held in the paper holder prior to printing on the paper by the printing head, the cutter being provided on a front edge of the cover of the paper roll holder and, when the cover is closed, the cutter is in a position on the paper feed path upstream of the printing head, so that as the roll of paper is unraveled a leading edge of an unraveled portion of the roll of paper passes the cutter to the printing head.

2. The printer as claimed in claim 1, further comprising:

a paper cut detector that detects cutting of a portion of the paper by the cutter; and a paper feeder which, in response to a detection by the paper cut detector, starts to feed an edge of a cut portion of the paper such that the edge of the cut portion of the paper reaches a position downstream of the printing head.

3. The printer as claimed in claim 1, wherein the paper feed path includes a platen roller, a paper guide and a feed roller.

4. The printer as claimed in claim 1, wherein a blade of the cutter is slanted with respect to a direction in a width of the paper unraveled from the paper roll.

5. A method for loading a paper roll into a printer, comprising:

setting a paper roll on a paper roll holder having a cover;

positioning a cutter on a front edge of the cover of the paper roll holder;

unraveling paper from the paper roll to a position passing the cutter to a position beyond the cutter;

cutting an unraveled portion of the paper roll held in the paper holder when the cover is closed and prior to printing on the paper; and driving a cut edge of the paper to a position downstream of a printing head.

6. A method for loading a paper roll to a printer comprising:

positioning a cutter on a front edge of a cover of a paper roll holder such that when the cover is closed, the cutter comes to a position on a paper feed path upstream of printing head; and cutting an unraveled portion of the paper roll being held in the paper roll holder when the cover is closed and prior to printing on the paper by a printing head.

* * * * *